US008287822B2

(12) United States Patent
Grudzien et al.

(10) Patent No.: US 8,287,822 B2
(45) **Date of Patent: *Oct. 16, 2012**

(54) REACTION SURFACE ARRAY DIAGNOSTIC APPARATUS

(75) Inventors: Jennipher Grudzien, Bend, OR (US); Charles M. McGrath, Bend, OR (US)

(73) Assignee: Grace Bio-Labs, Inc., Bend, OR (US)

( * ) Notice: Subject to any disclaimer, the term of this patent is extended or adjusted under 35 U.S.C. 154(b) by 29 days.

This patent is subject to a terminal disclaimer.

(21) Appl. No.: 12/780,639

(22) Filed: May 14, 2010

(65) Prior Publication Data

US 2010/0267590 A1 Oct. 21, 2010

Related U.S. Application Data

(60) Continuation of application No. 10/784,092, filed on Feb. 20, 2004, now Pat. No. 7,731,909, which is a continuation-in-part of application No. 10/349,347, filed on Jan. 22, 2003, now Pat. No. 7,736,594, application No. 12/780,639, which is a division of application No. 10/349,347, filed on Jan. 22, 2003, now Pat. No. 7,736,594.

(60) Provisional application No. 60/351,008, filed on Jan. 22, 2002.

(51) Int. Cl.
*B01L 3/00* (2006.01)

(52) U.S. Cl. ..... 422/552; 422/547; 422/551; 422/553

(58) Field of Classification Search ..... 422/547, 422/551, 552, 553, 560, 561, 563
See application file for complete search history.

(56) References Cited

U.S. PATENT DOCUMENTS

| | | | |
|---|---|---|---|
| 3,464,842 | A | 9/1969 | Jackstadt |
| 3,726,754 | A | 4/1973 | Coglianese et al. |
| 3,726,767 | A | 4/1973 | White |
| 3,745,091 | A | 7/1973 | McCormick |
| 3,883,398 | A | 5/1975 | Ono |
| 4,039,247 | A | 8/1977 | Lawman et al. |
| 4,299,920 | A | 11/1981 | Peters |

(Continued)

OTHER PUBLICATIONS

"Secure-Seal Hybridization Chambers," Grace Bio-Labs, Inc., Bend, Oregon, Publication date May 22, 2000, 1 page.

(Continued)

*Primary Examiner* — Jill Warden
*Assistant Examiner* — Dwayne K Handy
(74) *Attorney, Agent, or Firm* — Alleman Hall McCoy Russell & Tuttle LLP

(57) ABSTRACT

A reaction surface array diagnostic apparatus and method of making the same includes a substrate carrying a plurality of reaction surfaces, a plate and a gasket, each having a plurality of through bores, alignable with one of the reaction surfaces and forming a fluid tight well about each reaction surface when the gasket and the plate are sealingly affixed to the substrate to form a stack. Clamp members engage opposite side edges of a stack to compress the gasket. A plurality of side-by-side disposed clamped stacks of plates, gaskets and substrates are mounted in a tray in the standard footprint of a microtitre plate. Alternately, the plate and the gasket are combined into a single plate formed of a flexible material having an adhesive on one surface.

15 Claims, 19 Drawing Sheets

U.S. PATENT DOCUMENTS

| | | | | |
|---|---|---|---|---|
| 4,682,890 | A | | 7/1987 | De Macario et al. |
| 5,192,503 | A | | 3/1993 | McGrath et al. |
| 5,342,581 | A | * | 8/1994 | Sanadi ..... 422/552 |
| 5,424,213 | A | | 6/1995 | Mougin |
| 5,571,721 | A | | 11/1996 | Turner |
| 5,591,646 | A | | 1/1997 | Hudson et al. |
| 5,800,785 | A | | 9/1998 | Bochner |
| 5,972,694 | A | | 10/1999 | Mathus |
| 6,037,168 | A | | 3/2000 | Brown |
| 6,096,562 | A | | 8/2000 | Bunn et al. |
| 6,225,109 | B1 | | 5/2001 | Juncosa et al. |
| 6,277,629 | B1 | | 8/2001 | Wolf et al. |
| 6,376,233 | B1 | | 4/2002 | Wolf et al. |
| 6,426,050 | B1 | | 7/2002 | Pham et al. |
| 6,436,050 | B2 | | 8/2002 | Garrison et al. |
| 6,436,351 | B1 | | 8/2002 | Gubernator et al. |
| 6,485,690 | B1 | | 11/2002 | Pfost et al. |
| 6,623,701 | B1 | | 9/2003 | Eichele et al. |
| 6,699,665 | B1 | | 3/2004 | Kim et al. |
| 2001/0001644 | A1 | | 5/2001 | Coffman et al. |
| 2001/0007642 | A1 | | 7/2001 | Feiglin |
| 2001/0051113 | A1 | | 12/2001 | Juncosa et al. |
| 2002/0110925 | A1 | | 8/2002 | Mansky et al. |
| 2002/0141905 | A1 | | 10/2002 | Sha et al. |
| 2002/0192811 | A1 | | 12/2002 | Pitt et al. |

OTHER PUBLICATIONS

"CultureWell MultiSlip & SecureSlip," Grace Bio-Labs, Inc., Bend, Oregon, Publication date May 22, 2001, 6 pages.

"CultureWell MultiWell Coverslip Cell Cutlure Inserts," Grace Bio-Labs, Bend, Oregon, Publication Date 2000, 8 pages.

Corning, "Hybridization Chamber," <http://catalog2.corning.com/Lifesciences/en-US/Shopping/ProductDetails.aspx?productid=2551(Lifesciences)&categoryname=Genomics+and+Proteomics(Lifesciences)%7cHybridization+Chambers (Lifesciences)>, Access date: Oct. 14, 2010, 2 pages.

Telechem International Inc., "Hybridization Cassettes Handbooks," Arraylt Brand and Chemical Products, Access date: Oct. 8, 2002, 2 pages.

MWG Biotech Inc., "Hybridization Chamber," Access date: october 8, 2002, 2 pages.

Genetix, "Genetix Hybridization Chamber," <http://www.genpakdna.com/gtxhybcassette.shtml>, Access date Oct. 8, 2002, 2 pages.

Mendoza, L.G. et al., "High-Throughput Microarray-Based Enzyme-Linked Immunosorbent Assay (ELISA)," BioTechniques 27: 778-788, Oct. 1999, 12 pages.

* cited by examiner

FIG - 5A
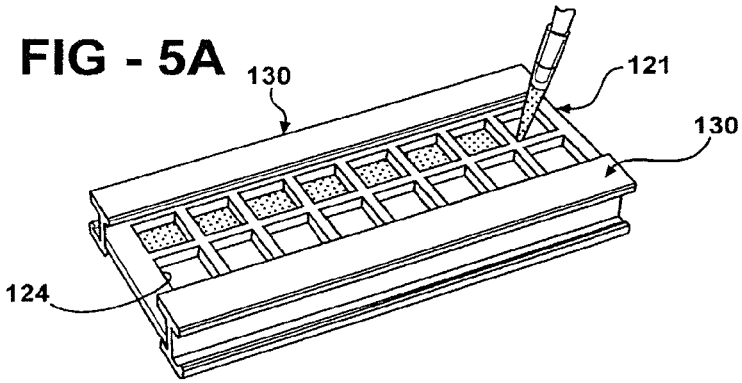
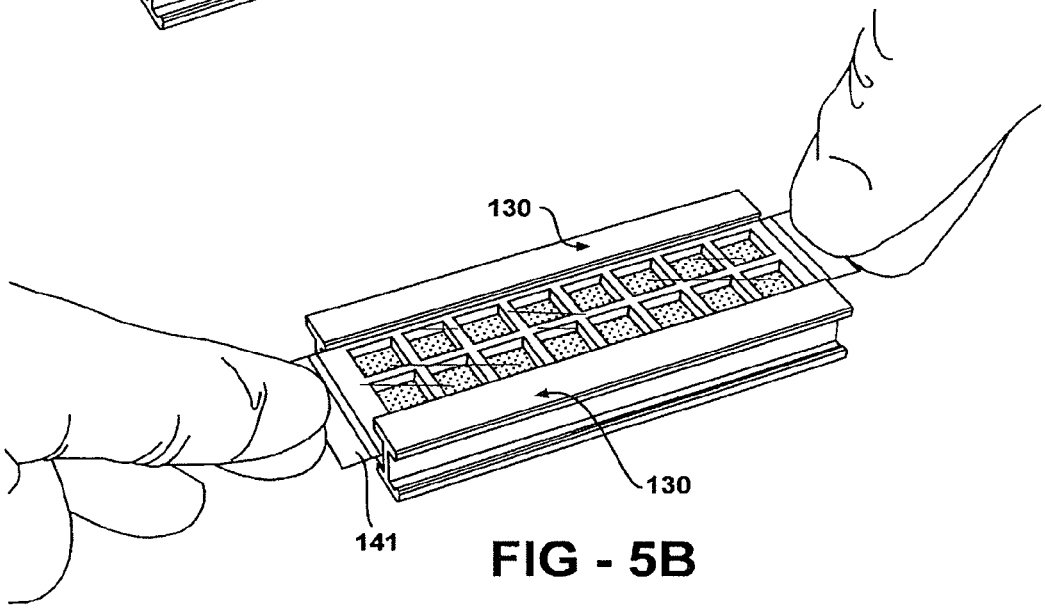
FIG - 5B
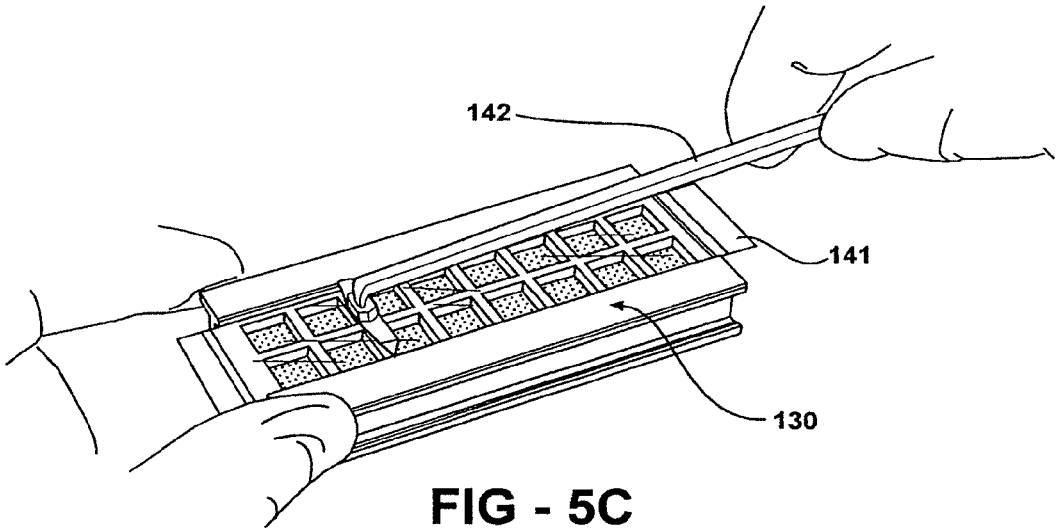
FIG - 5C

REACTION SURFACE ARRAY DIAGNOSTIC APPARATUS

CROSS REFERENCE TO CO-PENDING APPLICATION

This application is a continuation of U.S. patent application Ser. No. 10/784,092, filed Feb. 20, 2004 now U.S. Pat. No. 7,731,909, which is a continuation-in-part of U.S. patent application Ser. No. 10/349,347, filed Jan. 22, 2003 now U.S. Pat. No. 7,736,594 which claims the benefit of U.S. Provisional Patent Application Ser. No. 60/351,008, filed Jan. 22, 2002; this application is also a divisional of U.S. patent application Ser. No. 10/349,347, filed Jan. 22, 2003 now U.S. Pat. No. 7,736,594 which claims the benefit of U.S. Provisional Patent Application Ser. No. 60/351,008 , filed Jan. 22, 2002; the entire contents of all of which are incorporated herein by reference.

BACKGROUND

In situ diagnostic techniques have evolved into a high speed, highly automated process. Standard size test chambers in the form of microarrays of columns and rows of individual wells are formed by means of a microtitre plate or plates on a substrate to which the microtitre plate(s) is attached. The standard matrix of columns and rows is available in different sizes to suit different automated equipment. However, a common format is the use of microarrays on 1 mm thick, 25 mm×75 mm glass microscope slides.

The standard microtiter plate is approximately 86 mm×128 mm. Wells in microtitre plates are provided with standard spacing, such as a 9 mm spacing in a 96 well plate, which has the wells arranged in 12 columns and 8 rows. A 4.5 mm spacing between the centers of adjacent wells is used in a 384 well plate which has the wells arranged in 24 columns and 16 rows. A 2.25 mm spacing is used in a 1536 well plate, with the wells arranged in 48 columns and 32 rows.

It would be desirable to provide a simple and expedient means for creating a plurality of reaction surfaces on microscope slides in the footprint of a standard microtitre plate for use in automated in situ diagnostic apparatus. It would also be desirable to provide a reaction surface array diagnostic apparatus which provides an easy assembly of the individual apparatus components; yet an assembly which is easily disassembled. It would also be desirable to provide a reaction surface array diagnostic apparatus which includes means for securely retaining the apparatus components together during use.

SUMMARY

The present invention is a reaction surface array diagnostic apparatus and method of making the same.

In one aspect, the apparatus includes a substrate carrying a plurality of reaction surfaces. A gasket is sealingly mounted on the substrate. A plate is mounted on the gasket. The gasket and the plate include a plurality of through bores which form reaction chambers when the gasket sealingly affixes the plate to the substrate.

In one aspect, the gasket is a silicone gasket.

A cover may be applied over the substrate and the reaction chambers to seal the open end of each reaction chamber. The depth of the reaction chambers may be varied by varying the thickness of the gasket.

In another aspect, a clamp means for clamping the plate, the gasket and the substrate together and compressing the gasket to form a fluid tight seal about the reaction surfaces the clamp means includes a pair of clamp members, each having a pair of legs extending, one leg from opposed ends of a central wall. Preferably, each clamp member has an open channel formed between the legs and the central wall for joining one plate, one substrate and one gasket together into a stack.

In another aspect, a tray has an opening for releasably receiving the array, the array defining an overall size equaling the foot print of a standard microtitre plate.

In another aspect, an elongated open ended notch may be formed in the plate for receiving a projection formed on the end of at least one of the side legs of each clamp member for securing the clamp member to the joined substrate, gasket and plate.

In another aspect of the invention, a method of preparing a reaction surface array diagnostic apparatus is disclosed. The method comprises the steps of:

providing a substrate with a plurality of reaction surfaces on the substrate;

providing a gasket having a plurality of bores extending therethrough;

providing a plate having a plurality of through bores extending therethrough;

aligning the gasket with the plate and the substrate to align the bores in the gasket and the plate with the reaction surfaces on the substrate to form a well over each reaction surface; and compressing the gasket of each stack formed of one gasket, one plate, and one substrate to form a fluid tight seal about the reaction surfaces.

In another aspect, a non-releasable adhesive is disposed between the gasket and the plate to fix the gasket to the plate.

In another aspect, the plate and the gasket are combined into a single body formed of a flexible material, such as silicone. Wells extend through the body and are arranged in standard microtitre plate center-to-center spacing and provided in normal microtitre plate numbers, such as 96 wells, 354 wells, etc. The peripheral dimension of one piece flexible plate is the same as a microtitre plate.

One surface of the flexible plate, when the plate is formed of silicone, exhibits inherent short range acting forces which enables the plate to sealably, yet releasably mount on a suitable glass or silicone substrate carrying reaction surfaces, such as a glass plate having microtitre plate dimensions.

In another aspect, a pad or lip is carried on the peripheral edge of one surface of the flexible microtitre plate. The pad defines an interior recess surrounding the wells in size to receive one or more substrates.

The pad or lip can be fixedly attached to one surface of the microtitre plate by a releasable or non-releasable adhesive. Alternately, the pad or lip is homogeneously, integrally formed as part of the microtitre plate.

The apparatus and method of the present invention provide an expedient means for simultaneously conducting reactions on a plurality of reaction surfaces. The use of the gasket with through bores exclusively with a substrate carrying the reaction surfaces forms fluid tight reaction chambers or wells about each reaction surface by a minimal number of components. The use of the clamps insures that the reaction chambers remain sealed during the reaction.

In another aspect using the flexible, one-piece plate formed of a material providing the function of a sealable gasket, a microtitre sized reaction array may be provided for processing as a single, one-piece body which is itself releasably and sealingly mountable to a substrate, such as a glass plate carrying reaction surfaces or microarrays by non-mechanical, short range acting attraction forces inherent to the materials without the aid of chemical adhesives.

BRIEF DESCRIPTION OF THE DRAWING

The various features, advantages and other uses of the present invention will become more apparent by referring to the following detailed description and drawing in which:

FIGS. 5A-5C are perspective views showing further assembly and use steps of the aspect of the invention shown in FIG. 3 and FIGS. 4A-4E;

DETAILED DESCRIPTION

The present invention is a reaction surface array diagnostic apparatus 10 which creates a plurality of reaction surfaces on substrates, microscope slides, such as in the footprint of a standard microtitre plate.

Figure 1:
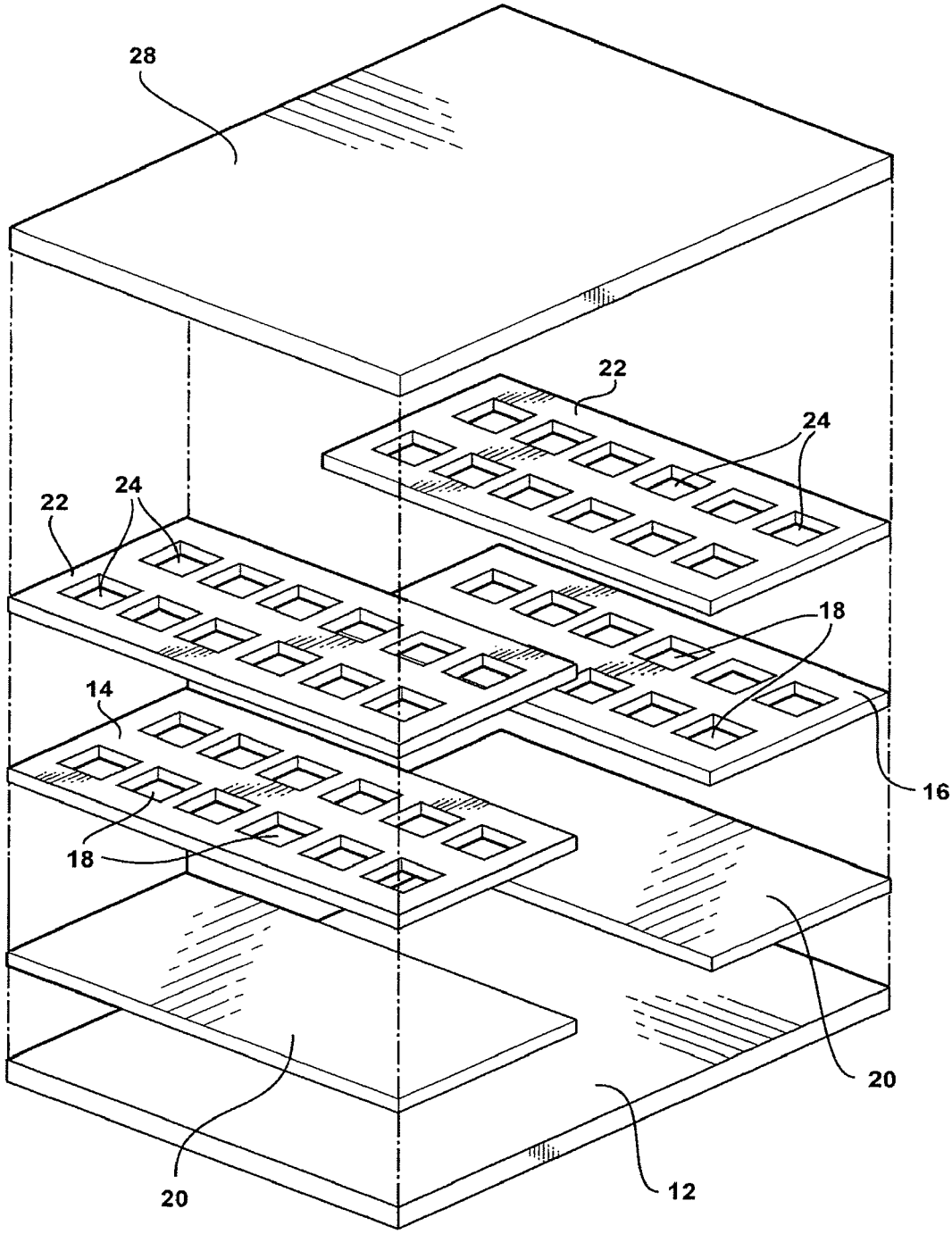
FIG. 1 is an exploded, perspective view showing one aspect of the present invention.

One aspect of the present invention is shown in FIG. 1 wherein the apparatus 10 includes an optional carrier plate 12 which has a generally planar surface and may also include raised sidewalls to form a receptacle or tray-like support as described later. The plate 12 is formed of glass or plastic, with transparent glass or plastic being preferred.

The plate 12 is sized to support a substrate, such as one or more standard sized (1".times.3") (25 mm.times.75 mm) microscope slide(s). In a preferred example, the plate 12 has the exterior dimensions of a 96 well plate (86 mm.times.128 mm) to receive four microscope slides 14, 16, etc., in a side-by-side array. The slides 14 are standard microscope slides formed of either glass or plastic, with generally transparent materials being preferred. The slides 14 are rigid and are not readily flexible.

A plurality of reaction surfaces 18 are formed on each slide 14. The reaction surfaces 18 are in the form of an array of microporous films, such as nitrocellulose films, or other films, for example only, or treated glass surfaces, such as glass treated with a protein binding solution. The reaction surfaces 18 are fixed in position on one surface of each slide 14 in a standard microarray. For example, the microporous or nitrocellulose films 18 are spun cast onto the surface of each slide 14 in the form of droplets and allowed to dry.

The slides 14 are positioned on the plate 12, preferably in a non-movable manner. An optional fixing element 20 may be employed to securely hold or fix each slide 14 in position on the plate 12. By way of example only, the fixing element is in the form of a thin (0.2 mm) clear silicone sheet 20 which provides the necessary friction to retain each slide 14 in position on the plate 12. The clear or transparent nature of the silicone sheet 20 also allows high resolution microscopy for cells arrayed on the films or reaction surfaces 18. At the same time, the silicone sheet 20 allows the slides 14 to be removed after reactions are completed.

The microporous films 18 which act as molecular binding or reaction areas on each slide 14 have a center-to-center spacing based on 9 mm in both the vertical and horizontal directions. A 9 mm spacing between reaction areas create 96 reaction areas that fit in the footprint of a microtitre plate. A 4.5 mm center-to-center spacing gives 384 areas in the footprint of a microtitre plate.

Reaction chambers are formed about each reaction surface 18 to provide chambers for receiving cells, proteins, antibodies, nucleic acid and other reaction elements for reaction with the films or treated areas 18. The reaction chambers are formed, according to the present invention, by a gasket 22, such as a silicone gasket, which has a plurality of through bores or wells 24 arrayed in the same 9 mm or 4.5 mm vertical and horizontal array spacing as the reaction surfaces 18 as a standard microtitre plate. This allows each through bore or well 24 to align with and surround one reaction surface 18 on the slide 14. The use of the silicone as the material to form the gasket 22 secures the reaction chambers in a stationary, non-movable position on each slide 14 about the reaction surfaces 18 due to the inherent sticky, but releasable nature of silicone.

Alternately, a non-releasable adhesive, not shown, such as an acrylic adhesive, is disposed between the gasket 22 and the slide 14 to fix the gasket 22 to the slide 14.

It is also feasible in the present invention to fluidically link two, three or more adjacent wells 24 together by small diameter flow channels extending through the gasket 22 between the wells 24. Any number and arrangement of wells 24 may be fluidically coupled in the gasket 22 while still retaining the preset center-to-center spacing between the wells 24

At the same time, the thickness of the gasket 22 may be varied or multiple gaskets may be stacked one on top of the other to provide a pre-determined reaction chamber or well depth for a particular volume of reactant.

The use of the gasket 22 to form the reaction chambers also prevents leaking between adjacent reaction chambers since the gasket 22 seals to the slide 14 to isolate each reaction surface 18 from adjacent reaction surfaces 18.

An optional cover member 28 may be applied over each gasket 22 and slide 14. Preferably, one single large cover 28, having the approximate dimensions of the plate 12, is applied over all of the gaskets 22 and the slides 14 mounted on the plate 12. The cover 28, which may be formed of plastic or glass and, preferably, transparent plastic or glass, is held in position sealing each reaction chamber formed by the wells 24 by engagement with the silicone gasket 22.

Alternately, the plate 24 may comprise four individual plates, each having the dimensions of one of the standard microscope slides 14.

In use, the reaction surfaces 18 are applied in the desired array to each slide 14. The slides 14 are then secured in position on the plate 12 by means of the fixing element or gasket 20.

One gasket 22 is then applied over each slide 14 to form one reaction chamber over each reaction surface 18. A particular reactant(s) is then applied to each reaction chamber or well 24. The optional cover 28 is then applied over the gaskets 22. At the completion of the reaction time, the elements are disassembled in a reverse order.

Figure 2:
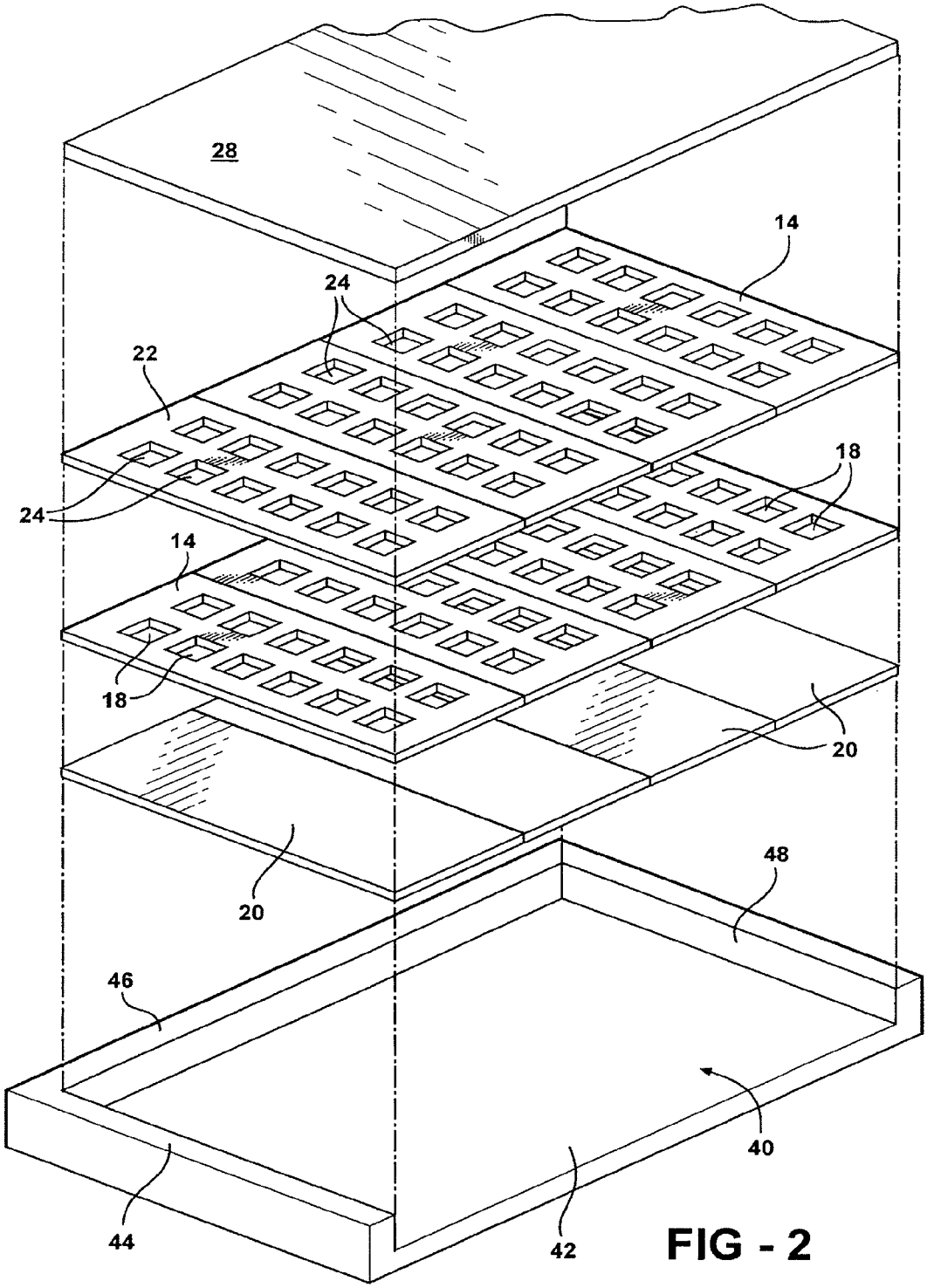
FIG. 2 is an exploded, perspective view of another aspect of the present invention.

FIG. 2 depicts an alternate aspect of the present invention which utilizes the same fixing element or gaskets 20, standard microscope slides 14, each having reaction surfaces 18 formed thereon, as well as the reaction chamber forming gaskets 22 and the optional cover 28 as described above and shown in FIG. 1.

In this aspect of the invention, the slides 14 and the fixing elements or gaskets 20 are mounted in a support or tray 40. The tray 40 has a generally planar central portion 42 which receives the fixing elements or gaskets 20 and the slides 14 in a side-by-side arrangement. The tray 20 includes a raised sidewall formed of interconnected sides 44, 46 and 48 which may be integrally formed with the planar central portion 42, but extend upward from the plane of the central portion 42 to form a raised edge along at least three sides of the central portion 42. The sides 44, 46 and 48 form a continuous support for positioning the slides 14 in the desired array on the tray 40 in the standard microtitre arrangement. The sides 44, 46 and 48 also cooperate with the fixing elements or gaskets 20 to hold the slides 14 in a stationary, non-movable position on the central portion 42 of the tray 40.

It should be noted that one side edge of the central portion 42 of the tray 40 is not provided with a raised side flange. This is to facilitate gripping of the slides 14 when inserting or removing the slides 14 to and from the tray 40. Otherwise, the operation of the tray 40 is the same as that described above for the invention shown in FIG. 1.

Referring now to FIGS. 3-11, there is depicted another aspect of the present invention. In this aspect, the diagnostic apparatus 100 also uses a substrate 102. The substrate 102 is also formed of glass or plastic, with transparent glass or plastic slides being preferred.

In one aspect, the substrate 102 is a microscope slide. Such slides are typically 1 inch by 3 inches (25 mm.times.75 mm) plain glass or plastic, such as polycarbonate, PMP or polystyrene. The glass microscope slides may be treated with suitable surface treatments for use as reaction surfaces for microarrays and tissue such as aminosilanes, superaldehydes, acylamide, epoxies, and nitrocellulose.

Figure 3:
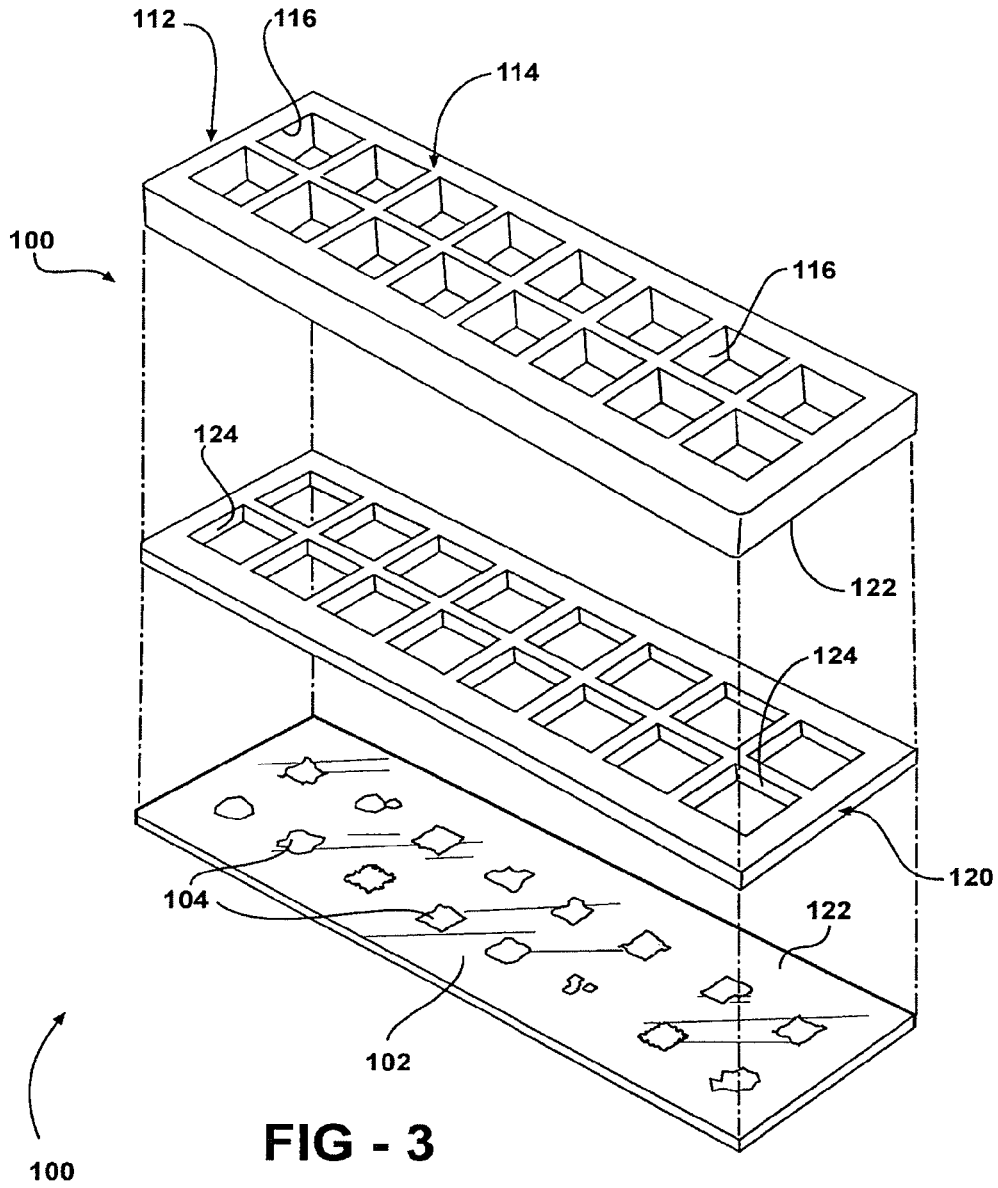
FIG. 3 is an exploded, perspective view of yet another aspect of the present invention.

By example only, the substrate 102 is depicted in FIG. 3 as being in the form of a standard one inch by three inch microscope slide. It will be understood that the dimensions of the substrate 102 may be varied as necessary to suit the needs of a particular application.

A plurality of reaction surfaces 104 are formed on each substrate 102 in the form of an array of microporous films, as described above. The reaction surfaces 104 are fixed in position on one surface of the substrate 102 in a standard microtitre array.

Figure 4A:
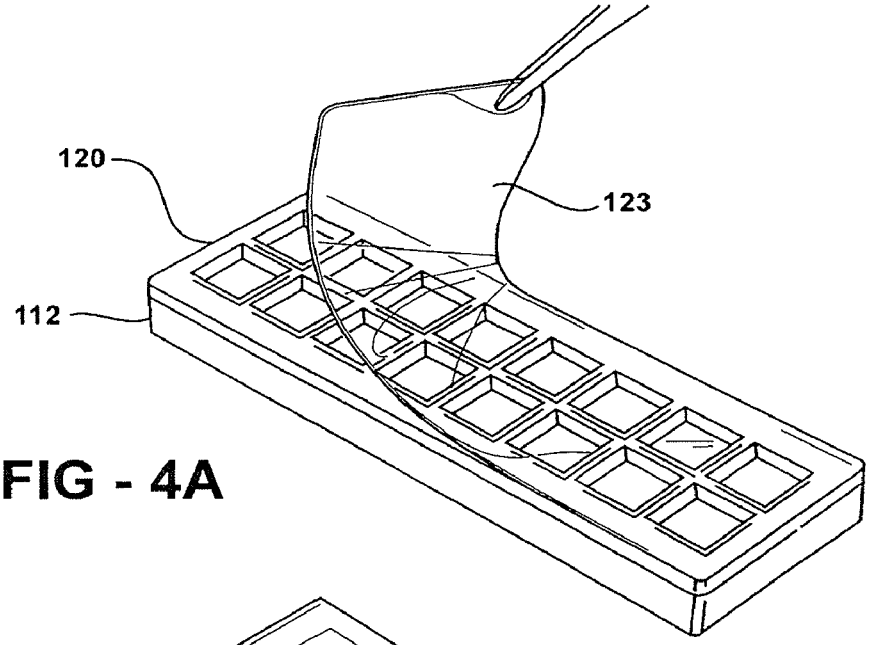
FIGS. 4A-4E are pictorial views showing the assembly steps of the aspect of the invention shown in FIG. 3.
Figure 4B:
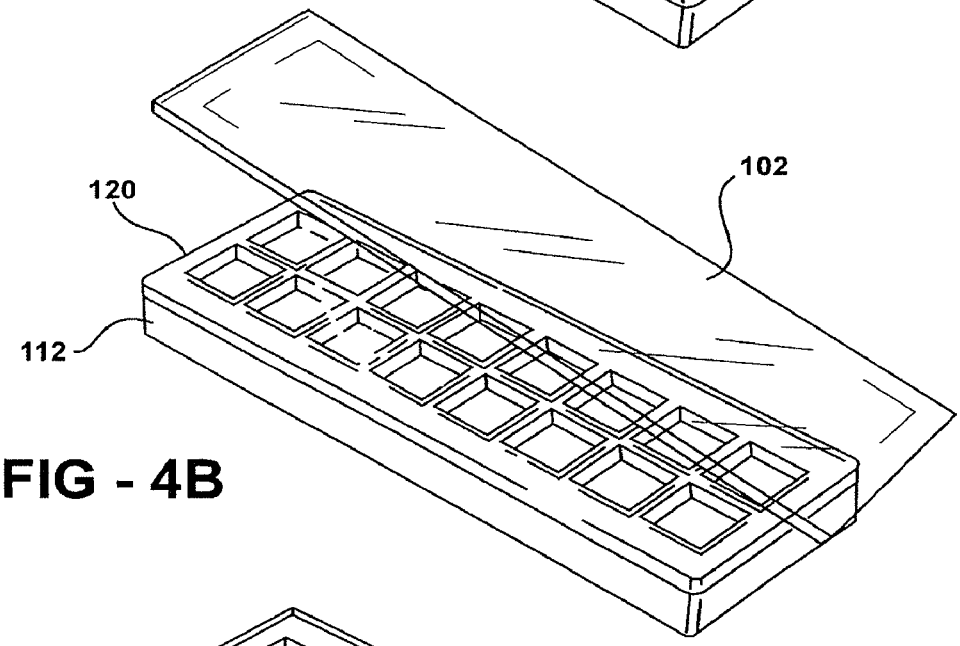
Figure 4C:
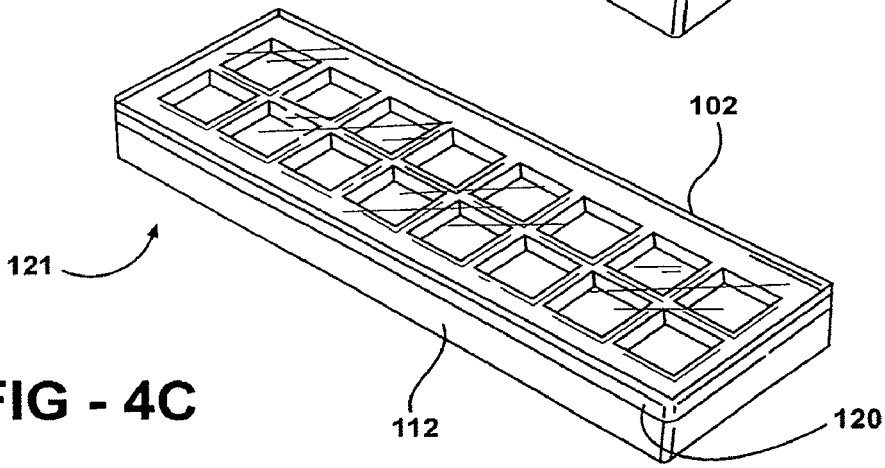
Figure 4D:
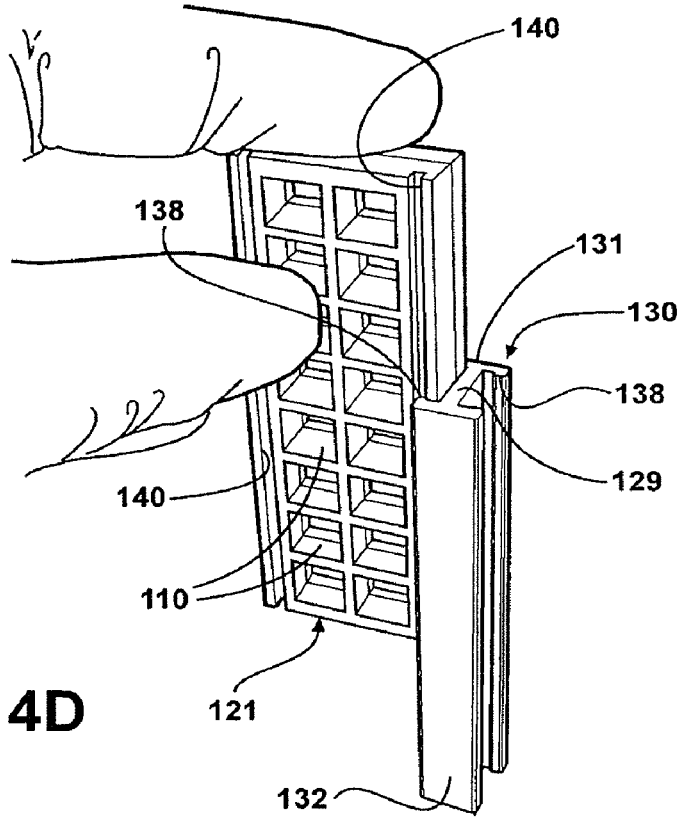

Reaction chambers denoted by reference number 110 in FIG. 4D are formed about each reaction surface 104 to provide wells for receiving cells, proteins, antibodies, nucleic acid or other reaction elements for reaction with the films or reaction surfaces 104. According to the present invention, the reaction chambers are formed by a plate 112 having a shape complimentary to the shape of the substrate 102. A plurality of individual bores 116, each typically having a polygonal shape, such as square bores, are formed through the plate 112 in an array. The wells can have any configuration having the same spacing as standard microplates. For example, the wells can be at 9 mm, 4.5 or 2.25 center to center spacings on a matrix.

The plate 112 is fluidically sealed to the substrate 102 by means of a seal or gasket 120 interposed between a first surface 122 of the plate 112 and one surface 122 of the substrate 102. The gasket 120 can be formed of any compressible material. In one aspect, the seal or gasket means 120 is a silicone gasket having a shape complimentary to the shape of the plate 112 and the substrate 102. The silicone used to form the gasket 120 provides it with sufficient resiliency to enable it to flex and bend during application to the substrate 102 or to the surface 122 of the plate 112. The seal or gasket 120 has a plurality of through bores 124 which are arranged in an array complimentary to the array of bores 116 in the plate 112. As shown in FIG. 6, the bores 116 in the plate 112 and the bores 124 in the gasket 120 combine to form the well or chamber 110 surrounding each film or reaction surface 104 formed on the substrate 102.

Gasket thicknesses of about 0.5 mm to 2.5 mm can be used. The overall shape of the gasket 120 approximate the shape or the plate 112 and the substrate 102.

Inherent physical and chemical characteristics of the silicone gasket 120 enables the gasket 120 to be non-moveably yet releasably secured to the surface 122 of the substrate 102 and, as well, to fixedly yet releasably attach the surface 122 of the plate 112 to an opposite surface of the gasket 120 through non-mechanical, short range acting forces, such as electrostatic forces, Van der Waal forces, etc. This cohesiveness is typically sufficient to retain the plate 112 on the gasket 120 in secure watertight engagement with the substrate 102 to prevent cross flow or fluid leakage between the various wells or chambers 110.

Enhanced adhesion can be had by providing a non-releasable adhesive, not shown, such as an acrylic adhesive, which cannot easily be removed from the gasket 120 or the plate 112, is disposed between the gasket 120 and the plate 112 to fix the gasket 120 to the plate 112.

A compressive force may be provided on the gasket by means of a clamp or clip means consisting of a pair of clamp members, each denoted by reference number 130. Each clamp or clip member 130 is formed of a resilient material, such as a plastic, and has a length sufficient to securely engage at least a portion of and, preferably, substantially all of the of the generally longer side edges of the substrate 102, the plate 112 and the gasket 120 as shown in FIG. 4, all of which form a stack 121.

Each clamp member 130 is formed as a unitary body of a suitable material, such as plastic. Each clamp member 130 has a central wall 129 and a pair of transversely extending side legs 131 and 132 carried on opposite ends of the central wall 131. Each of the side legs 131 and 132 is formed with arms projecting oppositely from the central wall 131. Thus, side leg 131 is formed of arms 134 and 135; while side leg 132 is formed with oppositely extending arms 136 and 137.

This arrangement forms the clamp member 130 with a generally I cross section. Opposed arms, such as arms 134 and 136 or arms 135 and 137, define opposed open-ended channels with the central wall 129 sized for receiving the longitudinal side edges of two stacks 121, each formed of the substrate 102, gasket 120 and plate 112.

The spacing between the arm pairs 134 and 136 and 135 and 137 is selected to provide a tight fit to provide clamping force along the longitudinally extending side edges of the stack 121.

Added securement between each clamp member 130 and the stack 121 is provided by projections 138 which may be formed on at least one of the arm pairs on the side legs 131 or 132, and, more preferably, on each of the arms of the side legs 131 and 132. As shown on the FIGS. 4D, 6B and 10, projections 138 are formed at the outer ends of each of the arms 134, 135, 136, and 137 and extend out of the plane of each arm 134, 135, 136, and 137 toward an opposite projection 138.

The projections 138 on the end of each side leg 134 and 136 firmly engage the outer surfaces of the plate 112 and the substrate 102. For secure mounting purposes, a recess 140 may be formed along the longitudinal or major dimension axis of one surface of the body 114 of the plate 112 slightly inboard of both of the longitudinally extending side edges. The recesses 140 are configured to receive the projections 138 in a snap-in fit as the clamp members 130 are urged over the side edges of the stack 121 of the substrate 102, gasket 120 and plate 112.

The assembly steps of the diagnostic apparatus 100 will be more clearly understood by reference to the sequential assembly steps shown in FIGS. 4A-6D.

The gasket 120 and the plate 112 are first joined together in a stacked arrangement. The inherent stickiness of the exterior surface of the silicone gasket 120 secures the gasket 120 to the plate 112 in a fluid tight manner, with each of the walls in the gasket 120 aligned with one of the wells in the plate 112. After the release liner 123 is removed from the opposed, exposed surface of the gasket 120, the substrate 102 is then mounted to the gasket 120 with each of the reaction surfaces 104 carried on the substrate 102 facing and disposed within one of the walls formed on the plate 112 and the gasket 120. This completes the stack 121 as shown in FIG. 4C.

Next, one of the clamp members 130 is engaged with one of the longitudinally extending side edges of the stack 121, with the side edges fully inserted into the open-ended channel formed on one side of the central wall 129 and one of the arm pairs, such as arm pair 134 and 136. In this position, as shown in FIGS. 4D and 4E, the projection 138 on the arm 136 engages the recess 140 formed on one side edge of the plate 112.

Figure 4E:
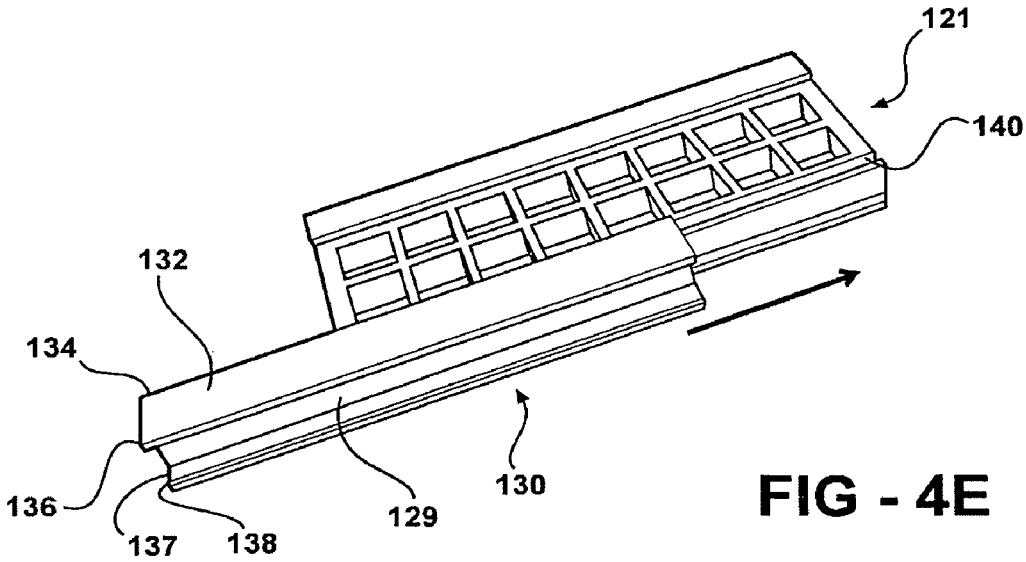

The same process is then repeated for the opposite clamp member 130 as shown in FIG. 4E until the arms 135 and 137 of the opposed clamp member 130 are disposed on opposite sides of the stack 121 of the plate 112, the gasket 120 and the substrate 102.

The stack 121 held together by the clamp members 130 can then be filed with suitable reactant as shown in FIG. 5A. An optional cover 141, shown in FIG. 5B, may be applied to the open end of the wells in the top plate 112 to prevent evaporation of the reactant. A scraper or other suitable tool 142, depicted in FIG. 5C, may be urged along the exposed surface of the cover 141 to smoothly adhere the cover 141 to the top surface of the plate 112.

Figure 6A:
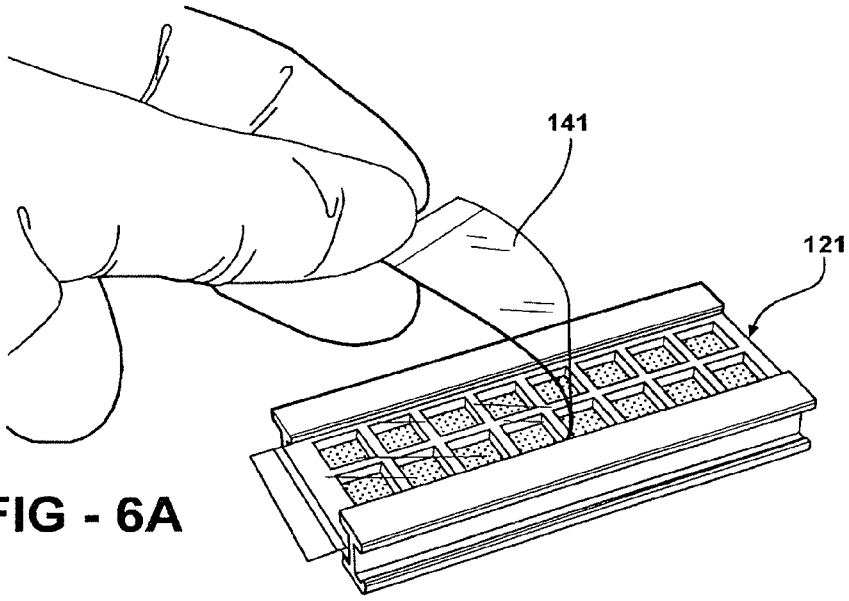
FIGS. 6A-6D are perspective views showing the disassembly steps of the assembly aspect of the invention shown in FIG. 5C.
Figure 6B:
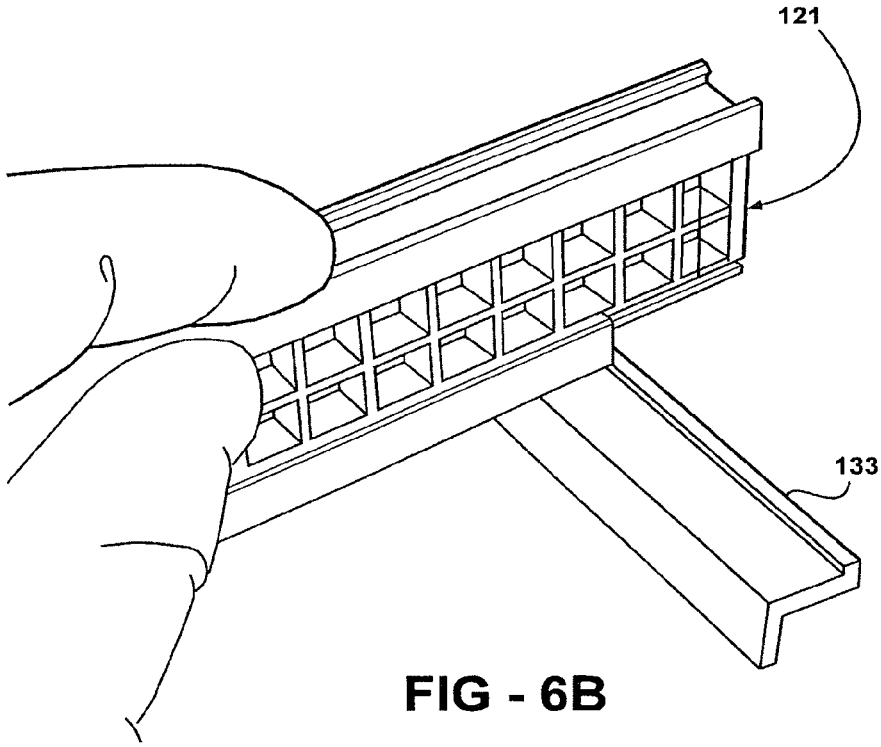
Figure 6C:
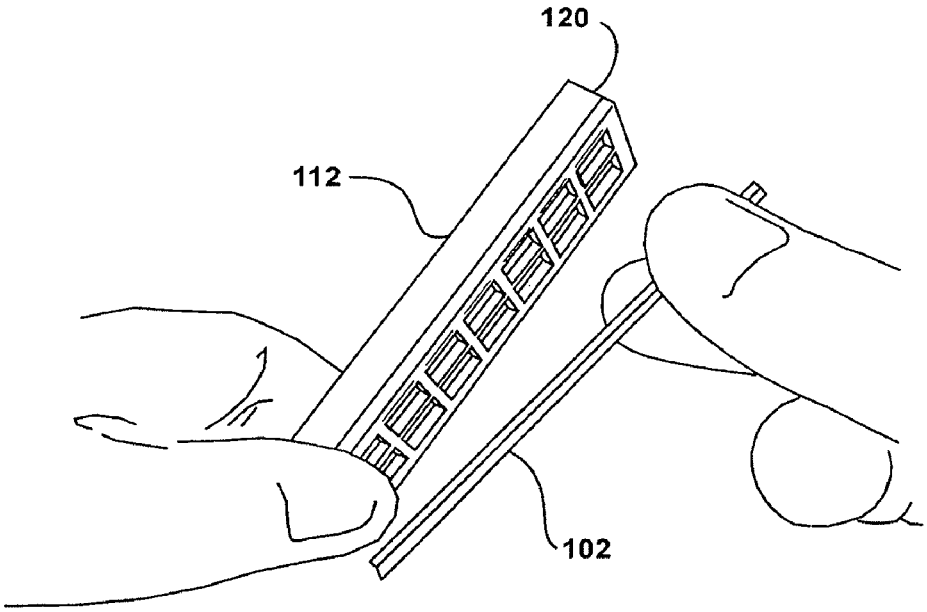
Figure 6D:
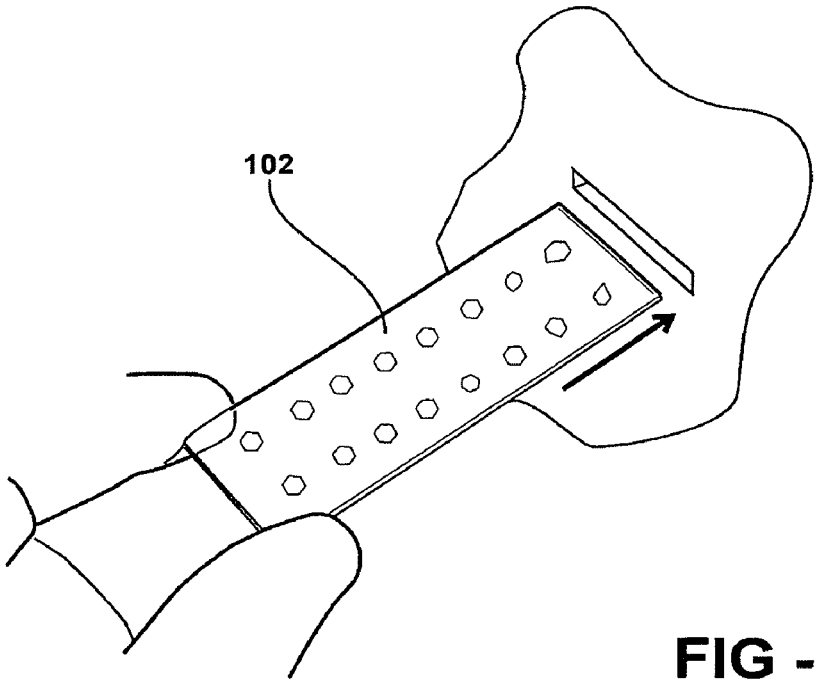
Figure 7A:
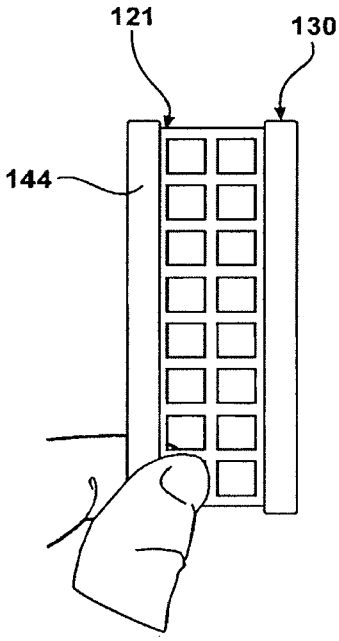
FIGS. 7A-7E are pictorial representations of assembly steps and forming an array of diagnostic apparatus according to the present invention.
Figure 7B:
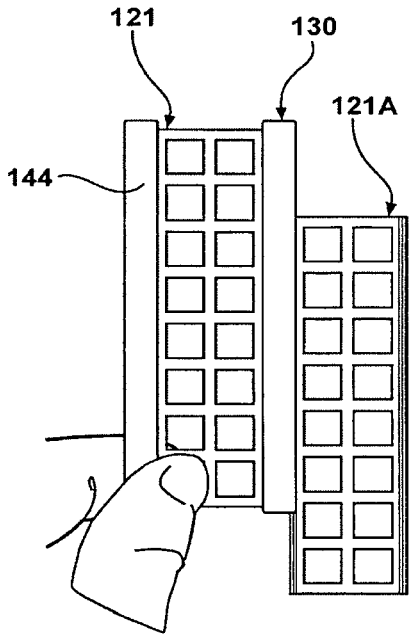
Figure 7C:
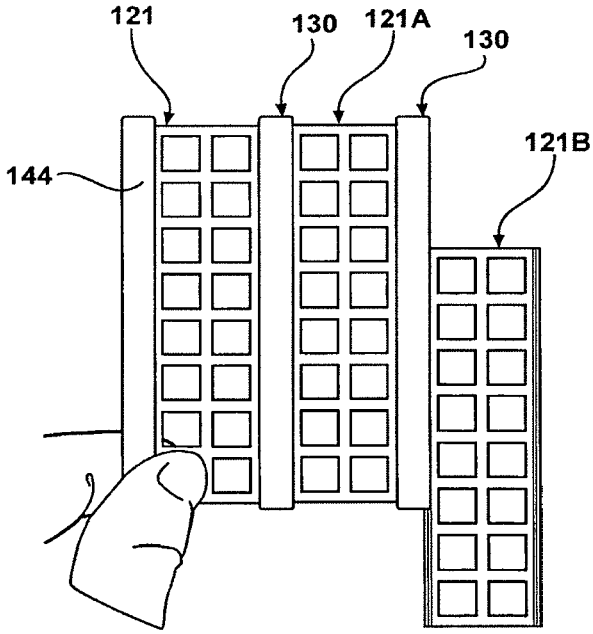
Figure 7D:
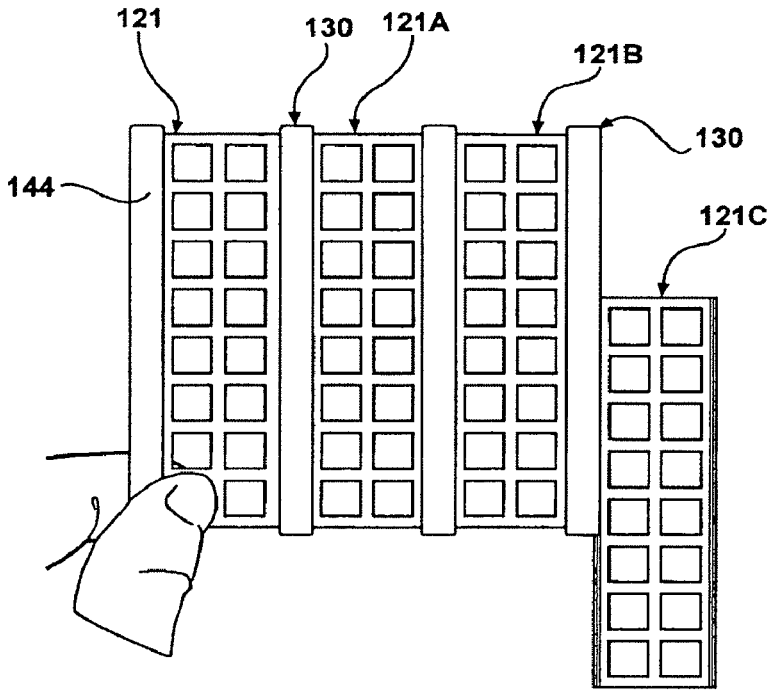
Figure 7E:
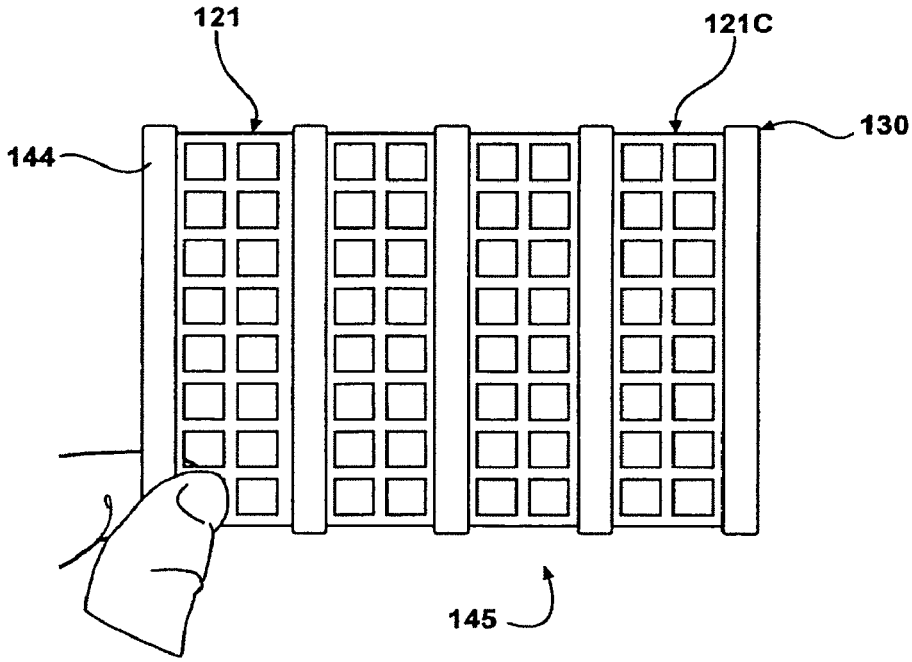
Figure 8:
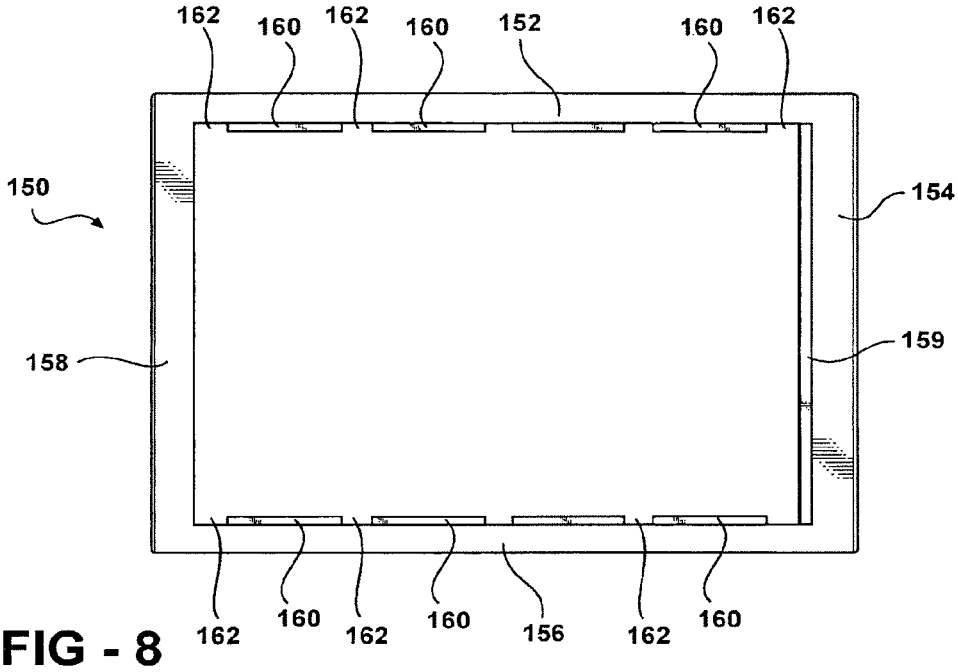
FIG. 8 is a plan view of a tray according to another aspect of the present invention.

Once the reaction has been completed, the cover 140 is as in FIG. 6A is removed and the reactant poured from the wells. The clamp members 130 are removed from the stack 121 by engaging the end of each clamp member 130 with a raised surface 133 on a tool or other support as shown in FIG. 6B. As seen in FIGS. 6C and 6D, the substrate 102 may be removed from the gasket 120 and processed as normal.

Figure 10:
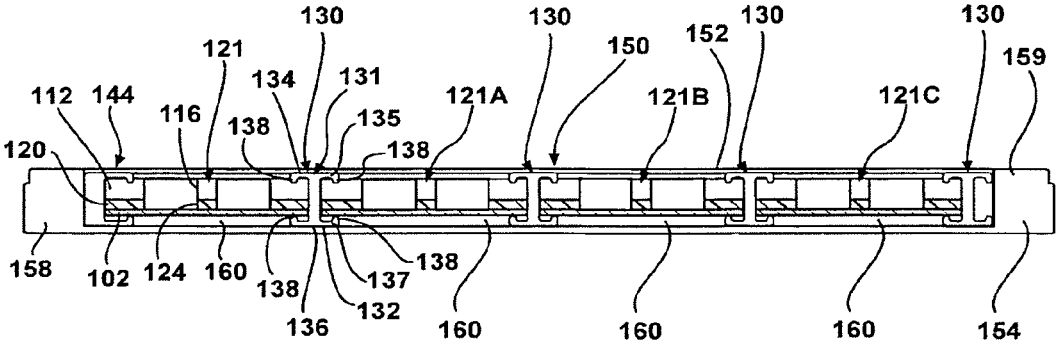
FIG. 10 is a cross-sectional view generally taken along line 10-10 in FIG. 11.
Figure 9:
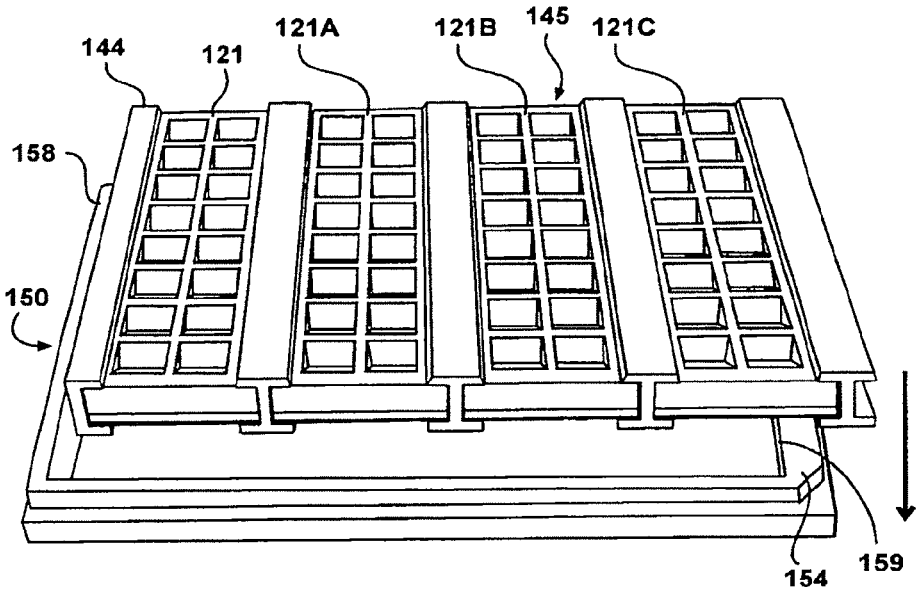
FIG. 9 is a perspective view showing the mounting of the array of FIG. 7A in the tray of FIG. 8.
Figure 11:
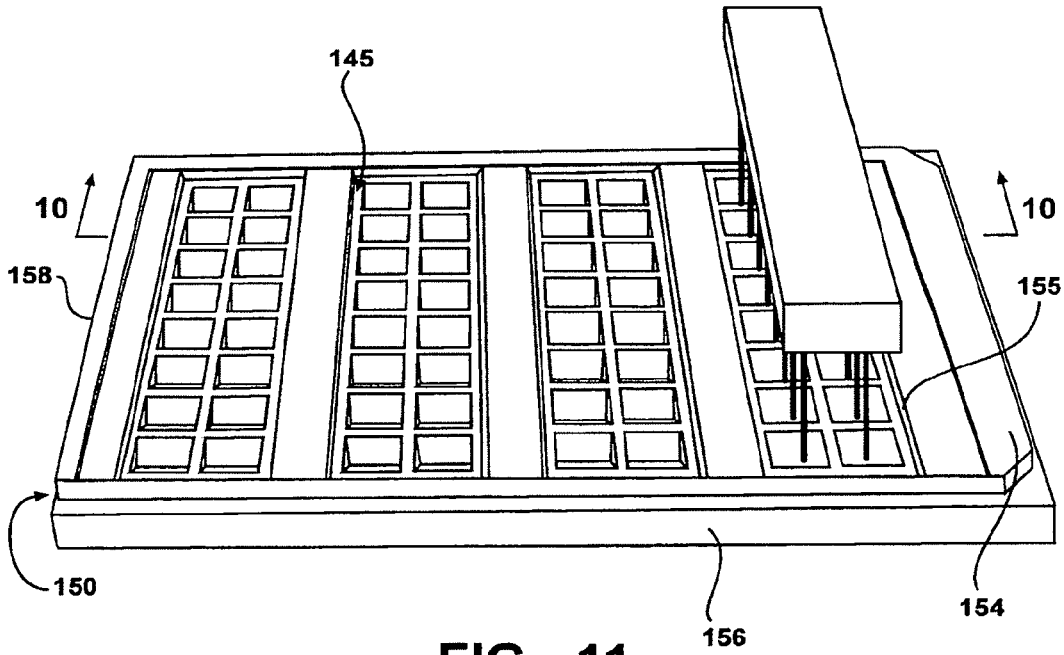
FIG. 11 is a perspective view showing the assembly array and tray of FIG. 12 is an end elevational view showing the mounting of the clips according to another aspect of the present invention on the stack.

Referring now to FIGS. 7A-7E, there is depicted the assembly of multiple stacks 121 into an array having the standard footprint of a microtitre plate. After the initial stack 121 is completed, with a modified clamp member 144 having a generally C-shape and with or without projections 138 on opposed arms attached to one endmost stack 121, adjacent stacks 121A, 121B, 121C are successively slide through the exposed open ended channel formed between the outer ends of additional clamp members 130. This is repeated until four stacks 121, 121A, 121B, and 121C are joined together by separate clamp members 130 in an array 145 shown in FIG. 7E. The array 145 is then mounted in a tray 150 shown in FIGS. 8, 9 and 11 which simplifies the handling of the array 145 in a pipette application, shown in FIG. 11. The tray 150 is formed as a unitary body having a peripheral wall formed of individual, joined wall segments 152, 154, 156, and 158 which define an inner cavity sized to receive the four joined stacks 121, 121A, 121B, and 121C of the array 145. A sloped or beveled edge 159 is formed on an inner top edge of the wall segment 154 to urge the array 145 tightly against the opposed wall segment 158. A plurality of flanges 160 are formed as part of the sidewalls 152 and 156 and project inward into the opening between the wall segments 152 and 156. The flanges 160 define intervening notches all denoted by reference number 162. The flanges 160, as shown in FIG. 10 are engagable by the substrates 102 in each stack 121, etc., when the array 145 of stacks is inserted into the tray 150. The individual clamp members 130 are positioned in the notches 162.

Figure 12:
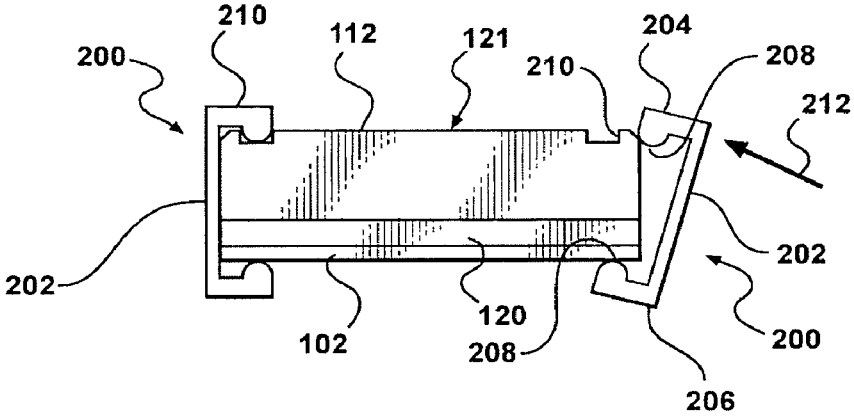
Figure 13:
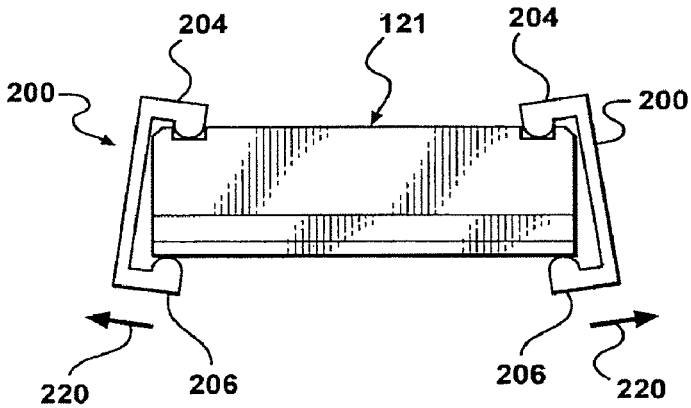
FIGS. 13 and 14 are end elevational views showing the disassembly of the clips depicted in FIG. 12 from the stack.

Referring now to FIG. 12, there is depicted another aspect of a clamp or clip member 200 as shown in FIG. 12. Two clamps 200 are employed with each stack 221 formed of the plate 112, the gasket 120 and the substrate 102.

In this aspect, each clamp member 200 is formed as the unitary body of a suitable material, such as plastic. Each clamp member 200 has a central wall 202 and a pair of transversely extending side legs 204 and 206 extending outwardly to the same side of opposite ends of the central wall 202.

This arrangement forms each clamp member 200 with a generally C-shaped cross-section. The opposed side legs 204 and 206 and the central wall 202 define an open-ended channel for receiving the longitudinal side edge of one stack 221. The spacing between the side legs 204 and 206 is selected to provide a tight fit to provide clamping force along the longitudinally extending side edge of each stack 221.

Added securement of each clamp member 200 on one stack 221 is provided by a projection 208 which may be formed on the end of at least one, and possibly both, of the side legs 204 and 206, with one projection 208 formed on the end of one side leg 204 being shown by way of example in FIG. 12. The projections 208 extend out of the plane of each side leg 204 and 206 toward the opposite side leg 204 or 206.

The projections 208 firmly engage the outer surfaces of the plate 112 and the substrate 102. For secure mounting purposes, a recess 210 may be formed along one edge, by example only, or along both longitudinal or major dimensional axes of one surface of the plate 112 slightly inboard of the longitudinally extending side edges. The recesses 210 are configured to receive the projections 208 in a snap-in fit as the clamp members 200 are urged over the side edges of the stack 121.

Enhanced adhesion can be had by providing a non-releasable adhesive layer 221, such as an acrylic adhesive, between the gasket 120 and the plate 112 to fix the gasket 120 to the plate 112. The adhesive 221 is a non-removable adhesive, that is, an adhesive that cannot be easily removed from the gasket 120 or the plate 112.

In assembling the diagnostic apparatus 10 using the clamps 200, the previously described assembly steps shown in FIGS. 4A-4C are initially performed. One clamp 200 at a time is placed in engagement with the stack 121 with one projection 208 initially disposed in contact with the plate 102. The opposite side leg 204 is tilted over the side edge of the plate 112 in the direction of arrow 212 until the projection 208 snaps into the recess or groove 210. The same assembly sequence is then applied to the opposite clamp 200.

Each clamp 200 is slid along the respective recess 210 in the manner shown in FIGS. 4D and 4E until the clamps 200 are coextensive or flush with the ends of the side edges of the stack 121.

The reactant insertion processes and use of the optional cover 141, shown in FIGS. 5A-5C can then take place using the clamped stack 121.

Figure 14:
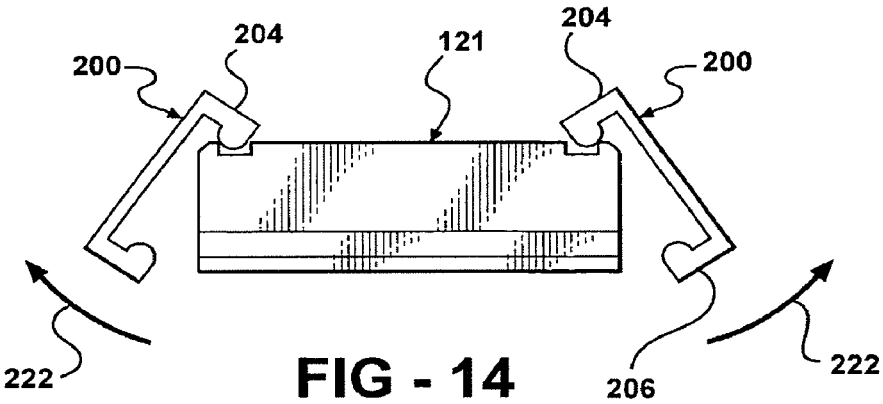

Once the reaction has been completed, the cover 140, as shown in FIG. 6A, is removed and the reactant poured from the wells. The clamp members 200 are removed from the stack 121 by grasping the clamp members 200 and exerting an outward directed force on side leg 206 in the direction of arrows 220 to pivot the clamp member 200 about the side edge of the stack 120. Continued upward pivotal force in the direction of arrows 222 as shown in FIG. 14 is applied to the side leg 206 until the projection 208 on the side leg 204 separates from the recess 210 in the plate 112. The substrate 102 may then be removed from the gasket 120 and processed as normal as shown in FIGS. 6C and 6D.

Figure 15:
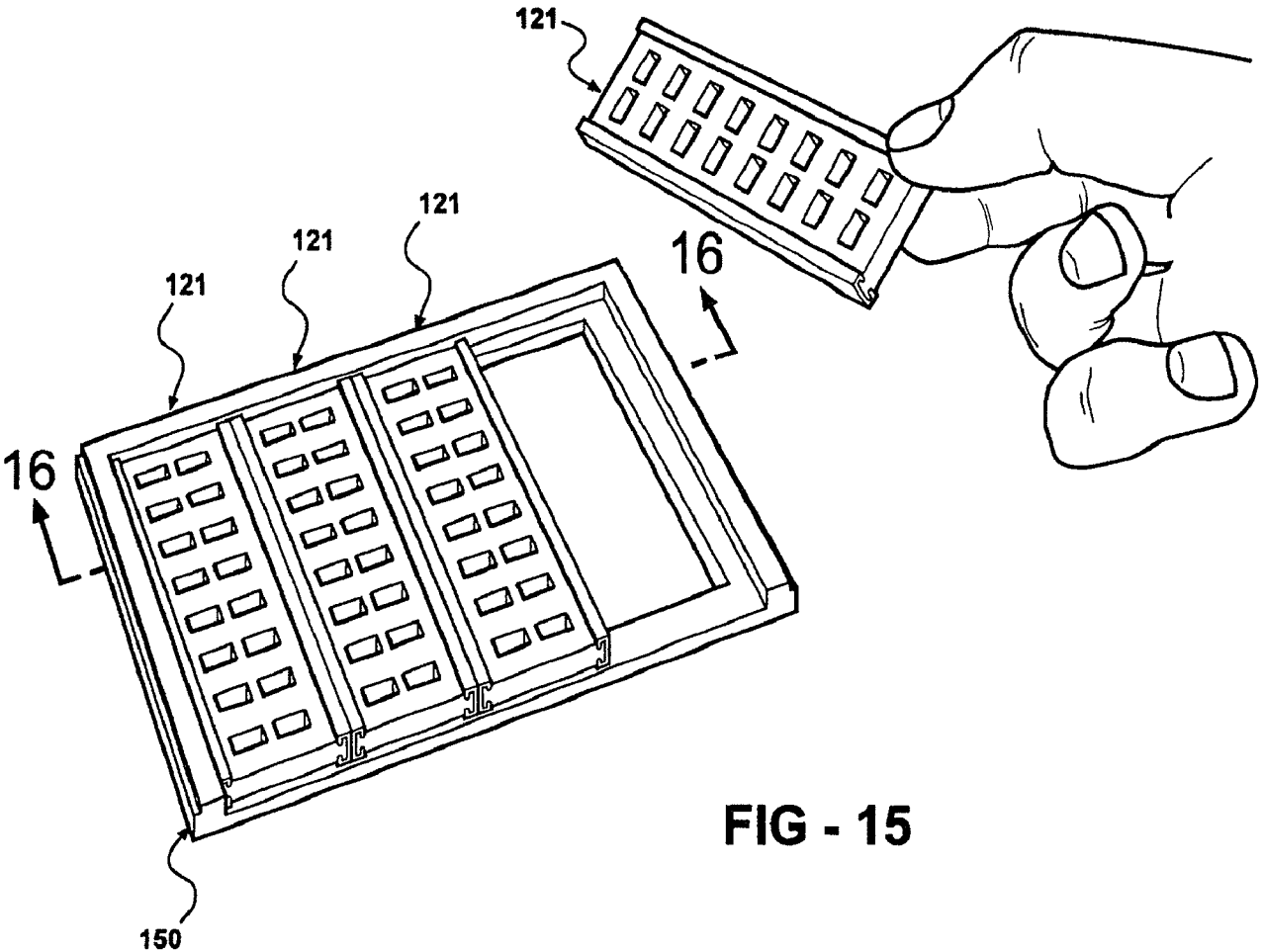
FIG. 15 is a perspective view showing an array of clipped stacks in the aspect of the invention shown in FIGS. 12-14 in the tray of FIG. 8.
Figure 16:
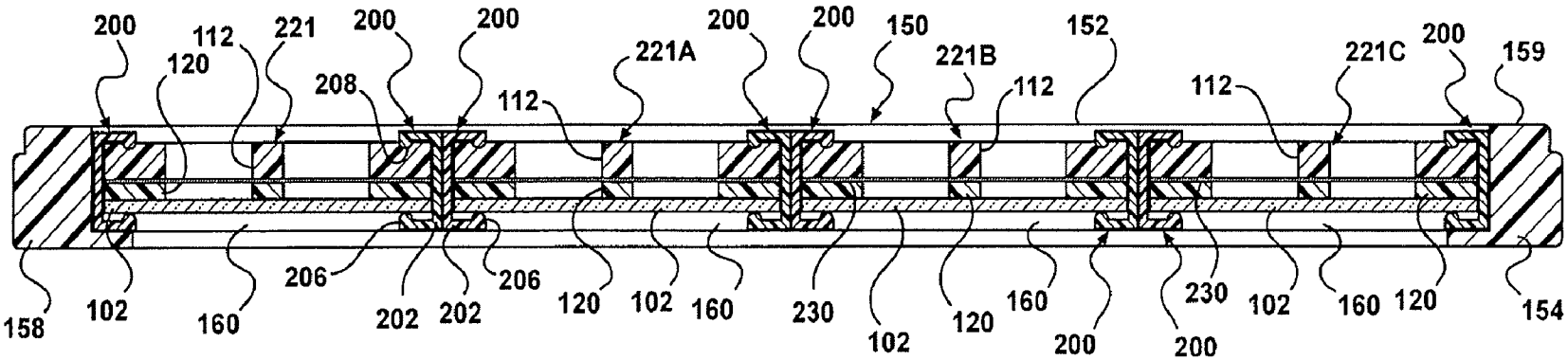
FIG. 16 is a cross-sectional view generally taken along line 16-16 in FIG. 15.
Figure 17:
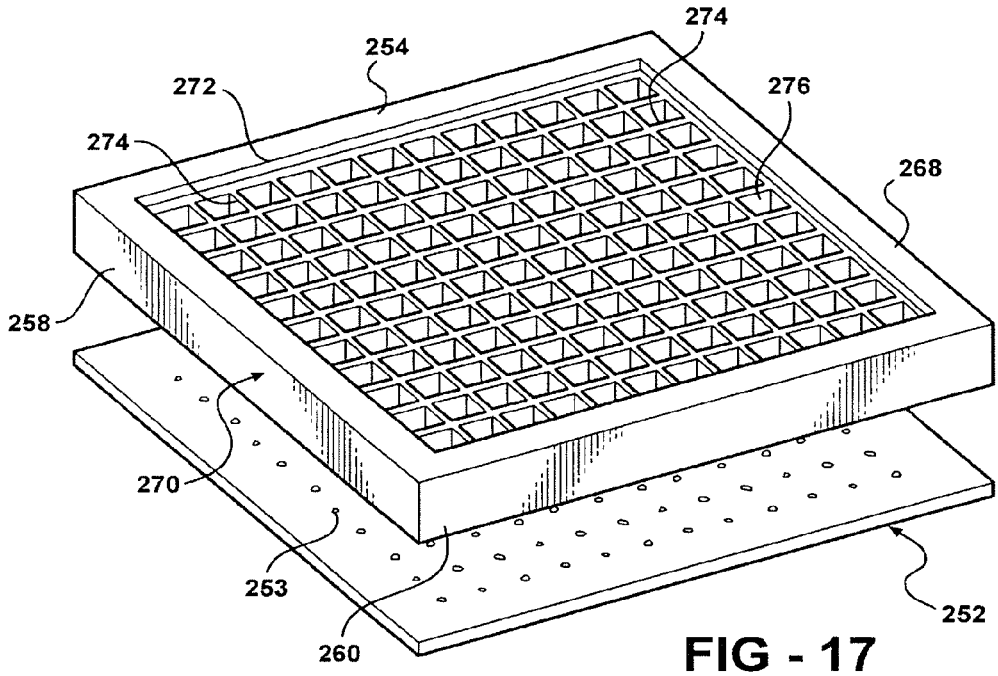
FIG. 17 is an exploded perspective view of another aspect of the present invention showing a flexible microtitre plate.

An alternate to the multiple stack array shown in 7A-7E, when using the clamps 200, is shown in FIGS. 15 and 16. The same tray 150 is employed for a plurality, with four clamped stacks 221, 221A, 221B and 221C shown by way of example only, being separately mounted in the tray 150. With four stacks 221, 221A, 221B and 221C, individually held together by clamps 200, each clamped stack 221 is inserted one at a time into the tray 150 as shown in FIG. 15. In this arrangement, the center legs 202 of two adjoining clamps 200 are disposed face-to-face, in an abutting arrangement as shown in FIG. 16. The clamped stacks 221, 221A, 221B and 221C fits snugly in the tray 150 in an array having the standard footprint of a microtitre plate. The entire tray 150 and the stacks 221, 221A, 221B and 221C may then be processed as normal.

Referring now to FIGS. 17-20, there is depicted a modification of the gasket in FIG. 1 as a large, single piece, unitary microtitre plate 250 formed to be flexible so as to be easily applied to and removed from a substrate 252.

The microtitre plate 250 has the overall exterior dimensions of a microtitre plate or approximately 86 mm.times.128 mm. This enables the microtitre plate 250 to be processed using pipette and plate washing robotics.

The microtitre plate 250 has a generally polygonal or rectangular configuration with a first upper surface 254, a second lower surface 256 and sidewalls 258, 260, 262, and 264.

Figure 18:
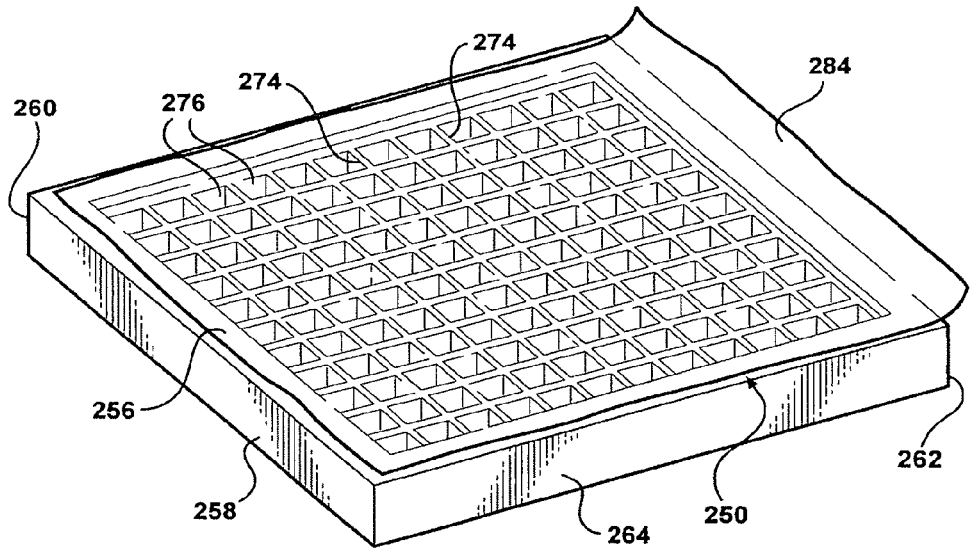
FIG. 18 is a perspective view of the bottom of the flexible microtitre plate shown in FIG. 17.
Figure 19:
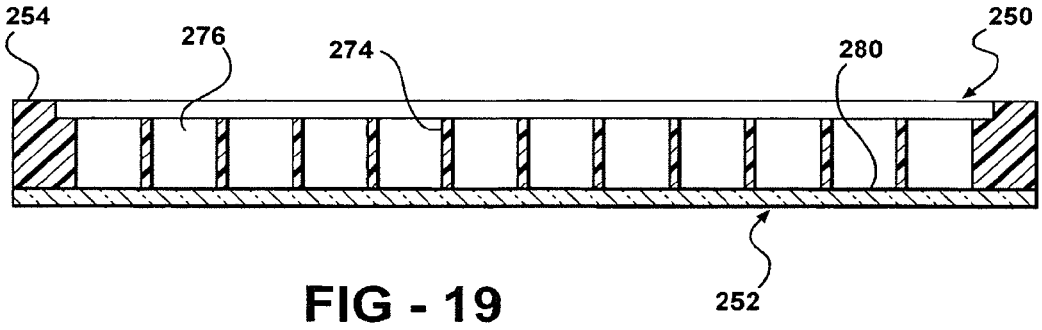
FIG. 19 is a cross sectional view through the joined microtitre plate and substrate.

A generally solid peripheral border denoted generally by reference number 268 extends inward from the sidewalls 258, 260, 262, and 264 and surrounds an inner array 270 of individual wells 272 which are formed by perpendicularly intersecting walls 274. An upper surface 276 of the walls 274 is shown by example as being flush with the top surface 254 of the plate 250. The opposed bottom edge of the walls 276 is also flush with the bottom surface 258, as shown in FIG. 18.

Figure 20:
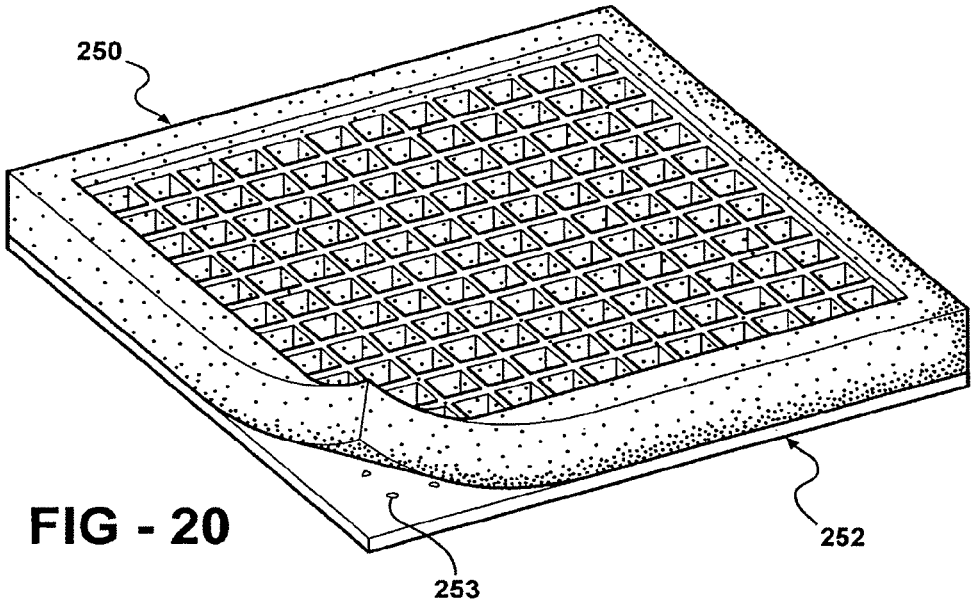
FIG. 20 is a perspective view of the separation of the flexible microtitre plate from the substrate.

The microtitre plate 250 is formed of a flexible material which nevertheless has sufficient rigidity to retain its shape for robotic handling, but can be flexed to assist in separation from the substrate 252, as shown in FIG. 20 and described hereafter. The plate 250 is also formed of a material that is compressible. In one aspect, the microtitre plate 250 is formed of silicone.

The microtitre plate 250 can be formed as a unitary body molded or extruded from silicone or multiple identically formed layers adhesively jointed together by a non-reversible adhesive, such as a an acrylic/silicone adhesive.

An adhesive 280 maybe applied over the bottom surface 256 covering the peripheral edge and the edges of the walls 276. The adhesive 280 may be a releasable adhesive, such as a double sided silicone/acrylic adhesive.

The adhesive 280 forms a reversible, separable bond with the substrate 252 which typically is formed of a rigid material, such as glass.

In use, the microtitre plate 250 is positioned with the first, upper surface 252 in a downward facing direction. A release cover 284 is removed from the opposed lower surface 256 exposing the adhesive layer 280. The substrate 252 carrying reaction surfaces and/or microarrays 253 arranged in standard microtitre plate well spacing, is then placed in contact with the adhesive 280 and the lower surface 256 of the microtitre plate 250 with alignment of the edges of the substrate 252 with the peripheral edges of the microtitre plate 250 to ensure that each reaction surface or microarray 253 on the substrate 252 is aligned with one of the wells 274 in the microtitre plate 250. The microtitre plate 250 and substrate 252 is now in condition for processing.

After processing is complete, the microtitre plate 250 can be separated from the substrate 252 by lifting one edge of the microtitre plate, as seen in FIG. 20, from the substrate 252 and then pulling and de-coupling the microtitre plate 250 from the remainder of the substrate 252.

FIGS. 21-24 depict another aspect of a diagnostic apparatus 300. In this aspect, the apparatus 300 is formed similarly to the apparatus 250 described above and shown in FIGS. 17-19 in that the microtitre plate 302 is formed of a flexible material, such as a flexible silicone, with wells arranged in a standard microtitre configuration and center-to-center well spacing.

In this aspect, the plate 302 has the layer of adhesive applied to one surface of the wells and the peripheral boundary of the plate 302 as described above.

In a unique feature, a pad or lip 304 having the same exterior peripheral shape and dimensions as the exterior of the microtitre plate 302 is applied over one surface of the plate 302. The pad 304 has an interior aperture 306 sized to expose all of the wells in the microtitre plate 302. For example, the pad 304 may have the same interior dimensions, such as 6 mm on the long sides and 9 mm on the shorter sides, as does the peripheral boundary of the microtitre plate 302.

Figure 21:
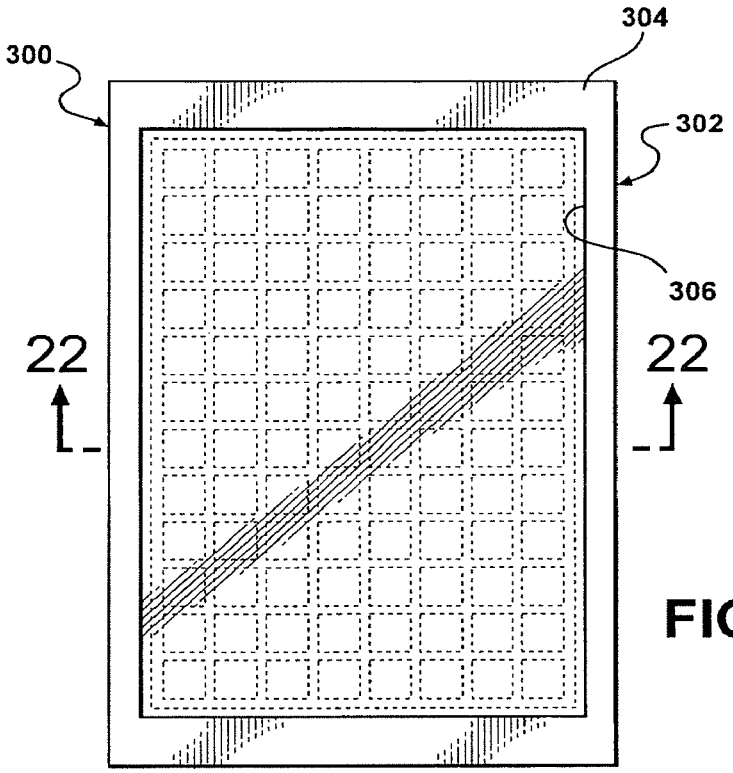
FIG. 21 is a plan elevational view of another aspect of a microtitre plate used in the diagnostic apparatus of the present invention.
Figure 24:
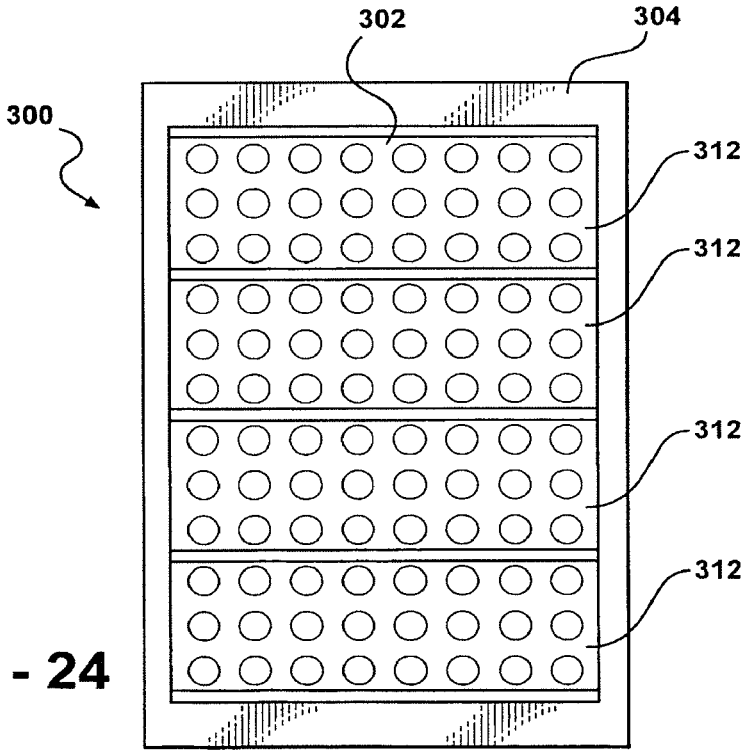
FIG. 24 is a plan elevational view showing the use of multiple substrates with a single microtitre plate according to the present invention.
Figure 22:
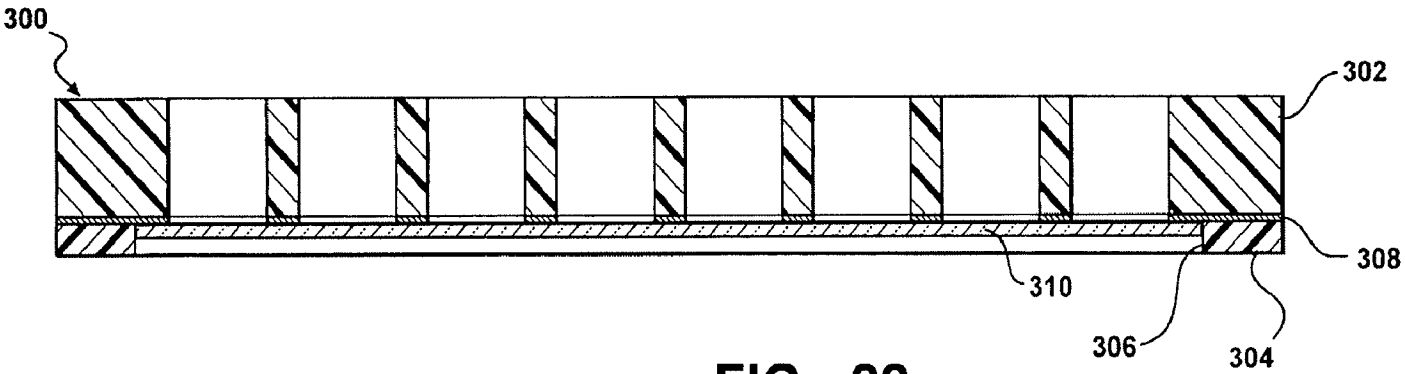
FIG. 22 is a cross sectional view generally taken along line 22-22 in FIG. 21.

As the pad 304 is a separate element from the microtitre plate 302, it is non-releasably fixed to the plate 302 by means of the adhesive 308 applied to one surface of the microtitre plate 302. As shown in FIGS. 21 and 22, the pad 304 forms an interior recess in the aperture 306 therein which is sized to receive a substrate 310, such as a large glass plate, two smaller plates, or as shown in FIG. 24, four substantially identical substrates, such as glass slides 312.

The substrate 310 will fit snugly within the aperture 306 and the pad 304 and be releasably secure to the adhesive layers 308.

Preferably, the pad 304 is formed of the same flexible material as that used to form the plate 302. For example, both the pad 304 and the plate 302 could be formed of flexible silicone. This enables the pad 304 and the plate 302 to be flexed at one edge, as shown in the earlier embodiment depicted in FIG. 20, and then slowly peeled away from the substrate 310.

The inherent attractive forces between the pad 304 and the plate 302 and the substrate 310 enable short range acting forces, such as electrostatic forces and Van der Waal forces, among others, to come into play when the two surfaces are brought into close proximity or contact to releasably fix the two surfaces together. Separation is readily implemented as described above to break the short range acting forces between the two surfaces.

It will be understood that the short range acting forces are non-mechanical forces, excluding clamps or clips, and does not involve the use of chemical adhesion.

It is should also be noted that the depth or height of the pad 304 is greater than the thickness of the substrate 310 so as to recess the substrate 310 completely within the interior of the aperture 306 and the pad 304 as shown in FIG. 22.

Figure 23:
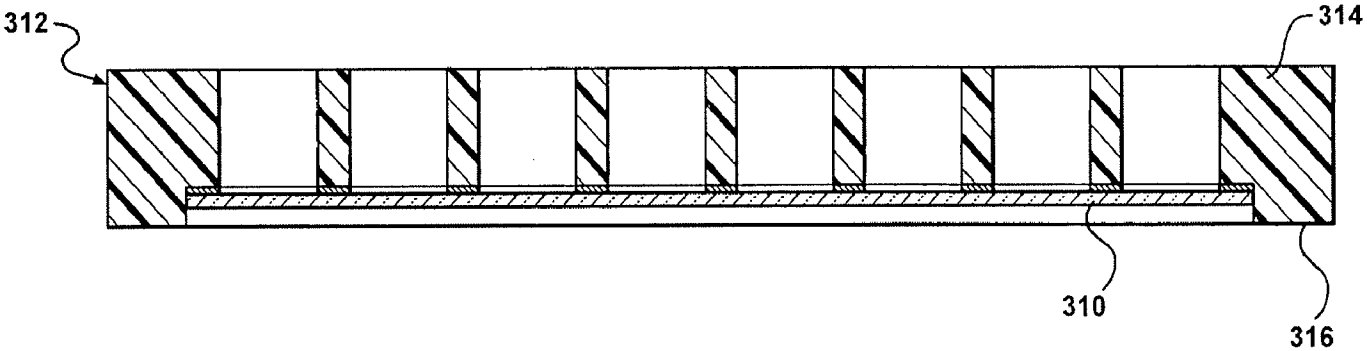
FIG. 23 is an enlarged cross sectional view, generally similar to FIG. 22, but depicting another aspect of a homogeneously formed pad/lip and microtitre plate.

In FIG. 23, the pad 304 described above is depicted as being homogeneously and integrally formed as part of a microtitre plate 314. The pad 304 in this aspect forms a lip 316 on one surface of the plate 314. The use and removal of the apparatus 312 shown in FIG. 23 is the same as that described above for the diagnostic apparatus 300 described in conjunction with FIGS. 21 and 22.

In FIG. 24, there is depicted a different substrate in which the substrate is formed of four substantially identical substrates, such as standard sized microscope slides. Each slide is reversibly adhesively sealed to one surface of the wells in the microtitre plate 302 or 314 and recessed within the aperture within the pad 304 or the lip extension 316.

One advantage of forming the entire plate 302 or 314 and the pad adhesively fixed or unitarily formed therewith of a flexible material, such as a flexible and compressible silicone is that the substrate 310 or 312 can be forced against one surface of the wells of the microtitre plate compressing the plate so as to ensure a leak proof seal between the substrate 310 and 312 and the surfaces of the plate between adjoining wells.

In summary, there has been disclosed a unique reaction surface array diagnostic apparatus which, in one aspect, utilizes a silicone gasket having at least one adhesive surface. The gasket includes a plurality of wells in combination with bores in a plate forms chambers around reaction surfaces carried on a substrate or slide. Unique clamps are employed for securing the substrate, gasket and plate together into a stack. A plurality of stacks can be mounted in a tray in the standard footprint of a microtitre plate. In one aspect, the gasket and the plate are combined into a one-piece microtitre formed of a flexible and/or compressible material. A footing plate may be separately attached to the flexible microtitre plate or integrally molded with the plate to form a recessed area on one surface of the plate for receiving the substrate.

What is claimed is:

1. A reaction surface array diagnostic apparatus comprising:

a single stack including a planar substrate; a plate having a plurality of wells extending therethrough disposed in a standard microtitre plate well spacing; a gasket, having a releasably adhering surface, sealingly coupling the plate to the planar substrate, the gasket having wells disposed in said microtitre plate well spacing and fluidically coupled to the wells in the plate and combining with the wells in the plate to form reaction chambers disposed in said microtitre plate well spacing, the substrate forming a bottom of the wells, and wherein the gasket is positioned between the plate and the planar substrate, and where the gasket has a first face contiguous with the plate and a second face contiguous with the planar substrate; and a pair of joinder members engageable with longer side edges of the stack, the pair of joinder members providing a clamping force to the longer side edges of the stack and extending inboard of the longer side edges of the stack on a top surface of the plate, wherein the wells of the plate are exposed when the stack is clamped by the pair of joinder members.

2. The reaction surface array diagnostic apparatus of claim 1, wherein the joinder members each include projections for interfacing with the plate, the projections having a rounded surface, the rounded surfaces engaging with the side edges of the plate to provide the clamping force to the stack.

3. The reaction surface array diagnostic apparatus of claim 1 wherein the plate includes a recess formed along one of its edges, the recess engaging in a snap-fit connection with a projection of one of the joinder members.

4. The reaction surface array diagnostic apparatus of claim 1 wherein the planar substrate includes a plurality of reaction surfaces within the reaction chambers, the reaction surfaces predeposited in microtitre well spaced bound arrays on the planar substrate.

5. A reaction surface array diagnostic stack consisting essentially of:

a planar substrate having a top and bottom face;

a rectangular-shaped plate having a plurality of rectangular-shaped wells extending therethrough disposed in a standard microtitre plate well spacing, the plate having a top and bottom face, and four sides;

a gasket, having a releasably adhering surface, sealingly coupling the bottom face of the plate to the top face of the planar substrate, the gasket having wells disposed in said microtitre plate well spacing and fluidically coupled to the wells in the plate and combining with the wells in the plate to form a plurality of separate reaction chambers disposed in said microtitre plate well spacing, the substrate forming a bottom of the wells, and wherein the gasket is positioned between the plate and the planar substrate; and a pair of joinder members engageable with side edges of the stack, the pair of joinder members providing a clamping force to the stack to compress the gasket between the plate against the planar substrate, the pair of joinder members each including a top and bottom projection, the top and bottom projections respectively engaging recesss in the top face of the plate and the bottom face of the planar substrate, without covering any of the wells such that all of the wells of the plate are exposed when the stack is clamped by the pair of joinder members.

6. The stack of claim 5, wherein the projections of each joinder member form a channel, the channel of each joinder member engaging a respective side of the plate.

7. The stack of claim 5 wherein the top projection of each joinder member includes a rounded surface, where the rounded surfaces engage with the top face of the plate in a snap-fit connection to provide the clamping force.

8. The stack of claim 6 wherein the top projection of each joinder member includes a rounded surface, where the rounded surfaces engage with the top face of the plate in a snap-fit connection to provide the clamping force.

9. A reaction surface array diagnostic apparatus comprising:

a plurality of stacks, each stack including a planar substrate; a plate having a plurality of wells extending therethrough disposed in a standard microtitre plate well spacing; a gasket, having a releasably adhering surface, sealingly coupling the plate to the planar substrate, the gasket having wells disposed in said microtitre plate well spacing and fluidically coupled to the wells in the plate and combining with the wells in the plate to form reaction chambers disposed in said microtitre plate well spacing, wherein the substrate forms a bottom of the wells;

a first pair of joinder members engageable with longer side edges of a first stack of the plurality of stacks, the first stack including a first plate;

a second pair of joinder members engageable with longer side edges of a second stack of the plurality of stacks, the second stack including a second plate, with each of the first and second pair of joinder members providing a clamping force to the longer side edges of each of said first and second stacks and extending inboard of the longer side edges of said first and second stack on top surfaces of the first and second plates, respectively, the plurality of stacks arranged into a planar array, with the wells in all of the plurality of stacks maintaining the microtitre plate well spacing across the array; and a tray supporting the stacks in the planar array, the tray defining a foot print of a standard microtitre plate.

10. The reaction surface array diagnostic apparatus of claim 9 wherein each of the first and second stacks is independently manipulatable.

11. The reaction surface array diagnostic apparatus of claim 10, wherein the reaction surface array diagnostic apparatus is configured such that assembly or disassembly of the first stack can occur while maintaining the sealed coupling and clamping force of the second stack.

12. The reaction surface array diagnostic apparatus of claim 9 wherein the first and second pairs of joinder members are C-shaped clamps.

13. The reaction surface array diagnostic apparatus of claim 9 further comprising a third pair of joinder members engageable with longer side edges of a third stack of the plurality of stacks, with the third pair of joinder members providing a clamping force to the longer side edges of the third stack, and with each of the first, second, and third stacks arranged into the planar array.

14. The reaction surface array diagnostic apparatus of claim 9 wherein the joinder members are independently manipulatable from the tray.

15. The reaction surface array diagnostic apparatus of claim 1, wherein the joinder members are slideable past shorter side edges of the single stack in a direction of the longer side edges of the single stack.

* * * * *